US009387957B2

(12) United States Patent
Fraser et al.

(10) Patent No.: US 9,387,957 B2
(45) Date of Patent: Jul. 12, 2016

(54) TRASH BAG WITH INNER BAG

(75) Inventors: Robert W. Fraser, Lombard, IL (US); Michael G. Borchardt, Naperville, IL (US); Jack A. MacPherson, Aurora, IL (US); Robert T. Dorsey, Western Springs, IL (US); Scott Binger, Bridgeview, IL (US); Shaun T. Broering, Fort Thomas, KY (US)

(73) Assignee: The Glad Products Company, Oakland, CA (US)

( * ) Notice: Subject to any disclaimer, the term of this patent is extended or adjusted under 35 U.S.C. 154(b) by 168 days.

(21) Appl. No.: 13/357,892

(22) Filed: Jan. 25, 2012

(65) Prior Publication Data

US 2013/0188889 A1 Jul. 25, 2013

(51) Int. Cl.
*B65D 33/28* (2006.01)
*B65F 1/00* (2006.01)

(52) U.S. Cl.
CPC ..... *B65D 33/28* (2013.01); *B65F 1/002* (2013.01); *B65F 1/0006* (2013.01)

(58) Field of Classification Search
CPC ..... C08F 10/00; B65D 31/04; B65D 33/28; B65F 1/0006; B65F 1/002; B31B 2237/05
USPC ..... 383/37, 38, 75, 109–114, 118, 908
See application file for complete search history.

(56) References Cited

U.S. PATENT DOCUMENTS 2,037,175 A * 4/1936 Northcross ..... 493/210
3,010,640 A 11/1961 Kugler et al.
3,494,457 A * 2/1970 Titchenal ..... 206/484
3,734,394 A * 5/1973 Dooley ..... 383/109
3,772,968 A 11/1973 Ruda
4,226,330 A * 10/1980 Butler ..... 383/207
4,273,549 A 6/1981 Pezzana et al.
4,588,650 A * 5/1986 Mientus ..... C08J 5/18 428/516
4,629,064 A 12/1986 Barner
4,846,586 A 7/1989 Bruno
4,890,936 A 1/1990 Cooper
4,925,711 A * 5/1990 Akao et al. ..... 428/35.2
4,993,844 A 2/1991 Robinson et al.
5,041,264 A * 8/1991 Williams ..... 422/28
5,171,523 A * 12/1992 Williams ..... 422/20
5,288,150 A * 2/1994 Bearman ..... 383/38
5,716,137 A 2/1998 Meyer
5,779,894 A * 7/1998 Martensson ..... 210/232

(Continued)

FOREIGN PATENT DOCUMENTS

WO WO97/29966 8/1997

OTHER PUBLICATIONS

International Search Report, mailed Apr. 12, 2013, from counterpart PCT/US 13/022993, filing date Jan. 24, 2013.

*Primary Examiner* — Peter Helvey
(74) *Attorney, Agent, or Firm* — Thomas C. Feix

(57) ABSTRACT

Trash bags may be formed to include first and second sidewalls joined along a first side edge, an opposite second side edge, and a closed bottom edge to form an outer bag. A second inner bag may be inserted within the first bag to form a "bag-in-a-bag" type configuration in which the inner bag is bonded to the outer bag along side seals. When the outer and inner bags are formed primarily from LLDPE thermoplastic resin using a blown film process, the inventors have surprisingly found that such configurations provide increased and unexpected strength properties while using less material.

20 Claims, 11 Drawing Sheets

(56) References Cited

U.S. PATENT DOCUMENTS

| | | | | |
|---|---|---|---|---|
| 5,804,265 | A * | 9/1998 | Saad et al. | 428/35.2 |
| 5,881,883 | A * | 3/1999 | Siegelman | 206/720 |
| 6,059,458 | A * | 5/2000 | Belias et al. | 383/75 |
| 6,371,643 | B2 * | 4/2002 | Saad et al. | 383/63 |
| 6,416,452 | B1 | 7/2002 | Meyer | |
| 7,300,395 | B2 * | 11/2007 | Sleight et al. | 493/215 |
| 7,712,962 | B1 * | 5/2010 | Reuhs et al. | 383/111 |
| 2001/0043763 | A1 * | 11/2001 | Saad et al. | 383/63 |
| 2004/0179754 | A1 | 9/2004 | Taheri | |
| 2005/0094903 | A1 * | 5/2005 | Nyambi | 383/116 |
| 2005/0137337 | A1 * | 6/2005 | Kwalk | 525/191 |
| 2009/0306323 | A1 * | 12/2009 | Kolb et al. | 526/348.4 |
| 2010/0046860 | A1 * | 2/2010 | Kent et al. | 383/75 |
| 2010/0074561 | A1 * | 3/2010 | Feig | 383/38 |
| 2010/0111452 | A1 * | 5/2010 | Ross | 383/75 |
| 2013/0188891 | A1 * | 7/2013 | Maxwell et al. | 383/75 |

* cited by examiner

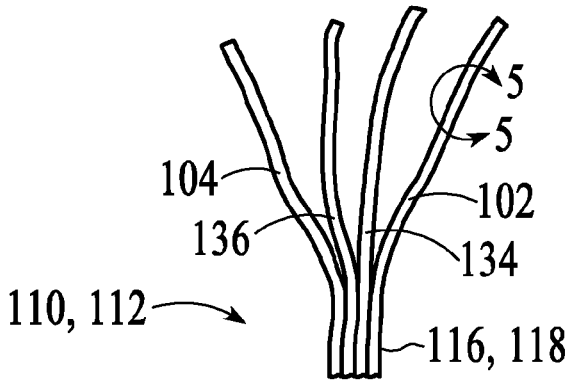
FIG. 4
FIG. 5A
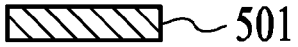
FIG. 5B
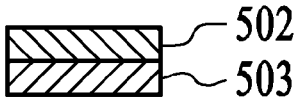
FIG. 5C
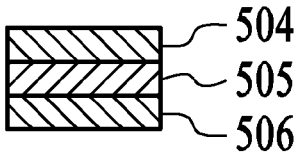

TRASH BAG WITH INNER BAG

BACKGROUND OF THE INVENTION

1. Field of the Invention

The present invention relates generally to trash bags. Specifically, the invention relates to trash bags of thermoplastic films having both an outer bag and an inner bag.

2. Description of the Related Art

One large use of plastic films is as thermoplastic bags for liners in trash or refuse receptacles. Trash receptacles that employ such liners may be found at many locations, such as, from small household waste baskets and kitchen garbage cans. The trash canisters are typically made from a rigid material such as metal or plastic. Bags that are intended to be used as liners for such refuse containers are typically made from low-cost, pliable thermoplastic material. When the receptacle is full, the thermoplastic liner actually holding the trash can be removed for further disposal and replaced with a new liner. To avoid inadvertently spilling the contents during disposal, the bags must be tear and puncture resistant. However, using very thick films for trash bags is not cost effective. Trash bags are typically formed by employing two pliable plastic sheets joined on three sides (or a U-folded plastic sheet joined on two sides) and open on the remaining side.

As is clear from the above discussion, continued improvement is needed to address the unique problems associated with improving the tear and puncture resistant of trash bags while conserving the use of expensive thermoplastic materials.

BRIEF SUMMARY OF THE INVENTION

Implementations of the present invention solve one or more problems in the art with apparatus and methods for creating trash bags with an outer bag and an inner bag with increased strength and decrease total amount of materials. In particular, one or more implementations provide for use of linear low density polyethylene in a blown film process.

BRIEF DESCRIPTION OF THE DRAWINGS

The foregoing aspects and others will be readily appreciated by the skilled artisan from the following description of illustrative embodiments when read in conjunction with the accompanying drawings, in which:

FIG. 4 is a cross-sectional view of the thermoplastic bag taken along line 4-4 of FIG. 1 and illustrating the side seal FIGS. 5A-5C are expanded cross-sectional views of the area indicated in FIG. 4 by circle 5-5, illustrating embodiments of the thermoplastic bag with a single, double, and triple layer ply;

DETAILED DESCRIPTION

Figure 1:
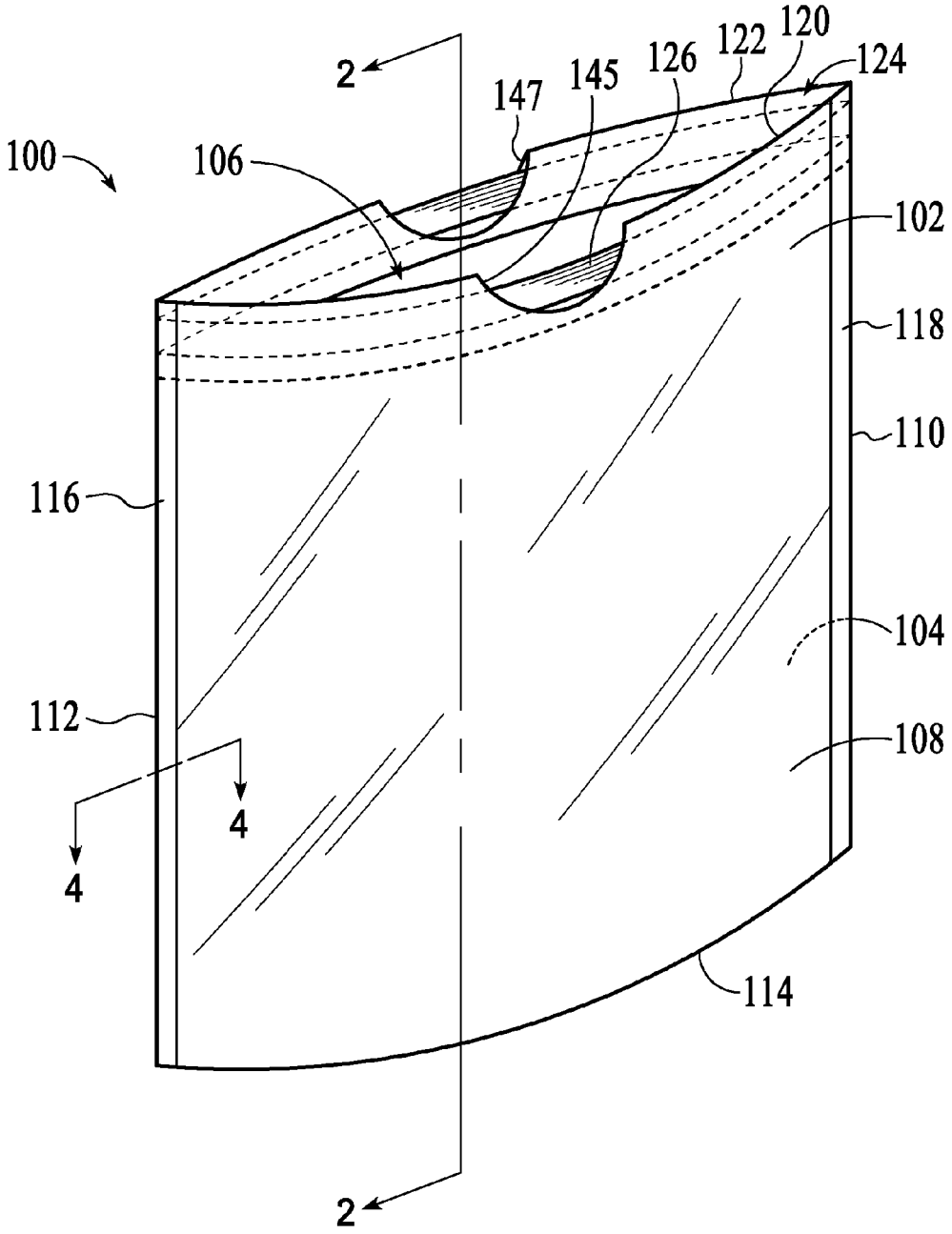
FIG. 1 is a perspective view of a thermoplastic bag having a draw tape.

Reference will now be made to the drawings wherein like numerals refer to like parts throughout. For ease of description, the components of this invention are described in the normal (upright) operating position, and terms such as upper, lower, horizontal, top, bottom, etc., are used with reference to this position. It will be understood, however, that the components embodying this invention may be manufactured, stored, transported, used, and sold in an orientation other than the position described.

Figures illustrating the components of this invention show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As utilized herein, the term "flexible" is utilized to refer to materials that are capable of being flexed or bent, especially repeatedly, such that they are pliant and yieldable in response to externally applied forces. Accordingly, "flexible" is substantially opposite in meaning to the terms inflexible, rigid, or unyielding. Materials and structures that are flexible, therefore, may be altered in shape and structure to accommodate external forces and to conform to the shape of objects brought into contact with them without losing their integrity.

As used herein, the term "orientation" refers to the molecular organization within a polymer film, i.e., the orientation of molecules relative to each other. Similarly, the process by which "orientation" or directionality of the molecular arrangement is imparted to the film refers to processes whereas the polymer is molten and not in the solid state. An example where process of orientation is employed to impart desirable properties to films, includes making cast films where higher MD tensile properties are realized. Depending on whether the film is made by casting as a flat film or by blowing as a tubular film, the orientation process employs substantially different procedures. This is related to the different physical characteristics possessed by films made by the two conventional film-making processes; casting and blowing. Generally, blown films tend to have greater stiffness and toughness. By contrast, cast films usually have the advantages of greater film clarity and uniformity of thickness and flatness, generally permitting use of a wider range of polymers and producing a higher quality film. When a film has been oriented in a single direction (monoaxial orientation), the resulting film exhibits great strength and stiffness along the direction of orientation, but it is weak in the other direction, i.e., orthogonal to the direction of the primary orientation, often splitting or tearing when flexed or pulled.

As used herein, the phrase "machine direction", herein abbreviated "MD", or "longitudinal direction", refers to a direction "along the length" of the film, i.e., in the direction of the film as the film is formed during extrusion and/or coating.

As used herein, the phrase "transverse direction", herein abbreviated "TD", refers to a direction across the film, perpendicular to the machine or longitudinal direction.

As used herein, the term "polyolefin" refers to any polymerized olefin, which can be linear, branched, cyclic, aliphatic, aromatic, substituted, or unsubstituted. More specifically, included in the term polyolefin are homopolymers of olefin, copolymers of olefin, copolymers of an olefin and a non-olefinic comonomer copolymerizable with the olefin, such as vinyl monomers, modified polymers thereof, and the like. Specific examples include polyethylene homopolymer, polypropylene homopolymer, polybutene, ethylene/alpha-olefin copolymer, propylene/alpha-olefin copolymer, butene/alpha-olefin copolymer, ethylene/unsaturated ester copolymer, ethylene/unsaturated acid copolymer, (especially ethyl acrylate copolymer, ethylene/butyl acrylate copolymer, ethylene/methyl acrylate copolymer, ethylene/acrylic acid copolymer, ethylene/methacrylic acid copolymer), modified polyolefin resin, ionomer resin, polymethylpentene, etc. Modified polyolefin resin is inclusive of modified polymer prepared by copolymerizing the homopolymer of the olefin or copolymer thereof with an unsaturated carboxylic acid, e.g., maleic acid, fumaric acid or the like, or a derivative thereof such as the anhydride, ester or metal salt or the like. It could also be obtained by incorporating into the olefin homopolymer or copolymer, an unsaturated carboxylic acid, e.g., maleic acid, fumaric acid or the like, or a derivative thereof such as the anhydride, ester or metal salt or the like.

In one embodiment, the invention comprises a draw tape bag having an interior and an exterior and comprising an outer bag having a first sidewall made of flexible thermoplastic web material and a second sidewall of a sheet of flexible thermoplastic web material of the same sheet folded, overlaid and joined to the first sidewall to provide an interior volume, the first and second sidewalls joined along a first sealed side edge, an opposite second sealed side edge, and a closed bottom folded edge, the first and second sidewalls un-joined along their respective top edges to define an opening opposite the bottom edge for accessing the interior volume; an inner bag separated from and within the interior volume of the outer bag and having a first sidewall made of flexible thermoplastic web material and a second sidewall of a sheet of flexible thermoplastic web material of the same sheet folded, overlaid and joined to the first sidewall to provide an interior volume, the first and second sidewalls of the inner bag joined along the first sealed side edge and the second sealed side edge of the outer bag, and a closed bottom folded edge of the inner bag, the first and second sidewalls un-joined along their respective top edges to define an opening opposite the bottom edge for accessing the interior volume; the first and second sidewalls of the outer bag and the first and second sidewalls of the inner bag folded over at the respective top edges and attached to the inside of the first and second sidewalls of the inner bag forming a hem extending along the open top end disposed opposite the bottom edge of the outer bag, the hem having a hem seal, the hem including one or more draw tape notches and a draw tape within the hem, the hem having an exterior surface and an interior surface where the outer bag first and second sidewalls form both the interior surface and the exterior surface of the hem; wherein the sidewalls of the outer bag and the sidewalls of the inner bag contain greater than 50% LLDPE and are produced by a blown film process.

In another embodiment, the invention comprises a draw tape bag having an interior and an exterior and comprising an outer bag having a first sidewall made of flexible thermoplastic web material and a second sidewall of flexible thermoplastic web material, overlaid and joined to the first sidewall to provide an interior volume, the first and second sidewalls joined along a first sealed side edge, an opposite second sealed side edge, and a closed bottom edge, the first and second sidewalls un-joined along their respective top edges to define an opening opposite the bottom edge for accessing the interior volume; an inner bag separated from and within the interior volume of the outer bag and having a first sidewall made of flexible thermoplastic web material and a second sidewall of flexible thermoplastic web material, overlaid and joined to the first sidewall to provide an interior volume, the first and second sidewalls of the inner bag joined along the first sealed side edge and the second sealed side edge of the outer bag, and a closed bottom edge of the inner bag, the first and second sidewalls un-joined along their respective top edges to define an opening opposite the bottom edge for accessing the interior volume; the first and second sidewalls of the outer bag and the first and second sidewalls of the inner bag folded over at the respective top edges and attached to the inside of the first and second sidewalls of the inner bag forming a hem extending along the open top end disposed opposite the bottom edge of the outer bag, the hem having a hem seal, the hem including one or more draw tape notches and a draw tape within the hem, the hem having an exterior surface and an interior surface where the outer bag first and second sidewalls form both the interior surface and the exterior surface of the hem; wherein the sidewalls of the outer bag and the sidewalls of the inner bag contain greater than 50% LLDPE and are produced by a blown film process and the combined thicknesses of the first sidewall of the outer bag and the first sidewall of the inner bag is less than 0.0015 inches (0.038 cm).

In another embodiment, the invention comprises draw tape bag having an interior and an exterior and comprising an outer bag having a first sidewall made of flexible thermoplastic web material and a second sidewall of flexible thermoplastic web material, overlaid and joined to the first sidewall to provide an interior volume, the first and second sidewalls joined along a first sealed side edge, an opposite second sealed side edge, and a closed bottom edge, the first and second sidewalls un-joined along their respective top edges to define an opening opposite the bottom edge for accessing the interior volume; an inner bag separated from and within the interior volume of the outer bag and having a first sidewall made of flexible thermoplastic web material and a second sidewall of flexible thermoplastic web material, overlaid and joined to the first sidewall to provide an interior volume, the first and second sidewalls of the inner bag joined along the first sealed side edge and the second sealed side edge of the outer bag, and a closed bottom edge of the inner bag, the first and second sidewalls un-joined along their respective top edges to define an opening opposite the bottom edge for accessing the interior volume; the first and second sidewalls of the outer bag and the first and second sidewalls of the inner bag folded over at the respective top edges and attached to the inside of the first and second sidewalls of the inner bag forming a hem extending along the open top end disposed opposite the bottom edge of the outer bag, the hem having a hem seal, the hem including one or more draw tape notches and a draw tape within the hem, the hem having an exterior surface and an interior surface where the outer bag first and second sidewalls form both the interior surface and the exterior surface of the hem; wherein the sidewalls of the outer bag and the sidewalls of the inner bag contain greater than 50% LLDPE film oriented in the MD direction and produced by a blown film process and the combined thicknesses of the first sidewall of the outer bag and the first sidewall of the inner bag is less than 0.0015 inches (0.038 cm).

Referring to FIG. 1, there is illustrated a thermoplastic bag 100 of the kind useful as a liner for trash receptacles and refuse containers. Of course, the illustrated bag may have additional or different uses. The bag 100 may have and outer bag 108 with a first sidewall 102 and opposing second sidewall 104 overlaid and joined to the first sidewall to define an interior volume 106 for holding trash. The first and second sidewalls may have matching rectangular or square shapes and may be joined along a first sealed side edge 110, a second sealed side edge 112 that may be parallel to and spaced apart from the first side edge, and a closed folded bottom edge 114 that extends between the first and second side edges. Alternately, the bottom edge 114 can be heat sealed. The sidewalls 102, 104 may be joined along their edges to form side seals 116, 118 using any suitable joining process such as, for example, heat sealing in which the thermoplastic material bonds or melts together. Other sealing or joining processes may include ultrasonic methods and adhesive.

The first and second sidewalls 102, 104 may be made of flexible or pliable thermoplastic material formed or drawn into a smooth, thin-walled web or sheet. Examples of suitable thermoplastic materials may include polymers, for example, polyethylenes (such as, high density polyethylene, low density polyethylene, linear low density polyethylene, very low density polyethylene, ultra low density polyethylene), or other polymers as described within. When used as a garbage can liner, the thermoplastic material will typically be opaque but could also be transparent, translucent, or tinted. Furthermore, the material used for the sidewalls may provide a fluid barrier, such as, a liquid barrier and/or a gas barrier and may include other features such as being treated with deodorants and/or disinfectants as is sometimes desirable in the production of trash can liners. To access the interior volume 106, the top edges 120, 122 of the first and second sidewalls between the first and second side edges and which are located opposite the bottom edge 114 may remain un-joined to provide the periphery of an opening 124. To close the opening 124 of the bag 100 when, for example, disposing of the trash receptacle liner, the bag may be fitted with a draw tape 126. To access the draw tape 126, as illustrated in FIG. 1, first and second notches 145, 147 may be disposed through the respective first and second top edges 120, 122. Pulling the draw tape 126 through the notches 145, 147 constricts the top edges 120, 122 thereby drawing closed the opening 124.

Figure 2:
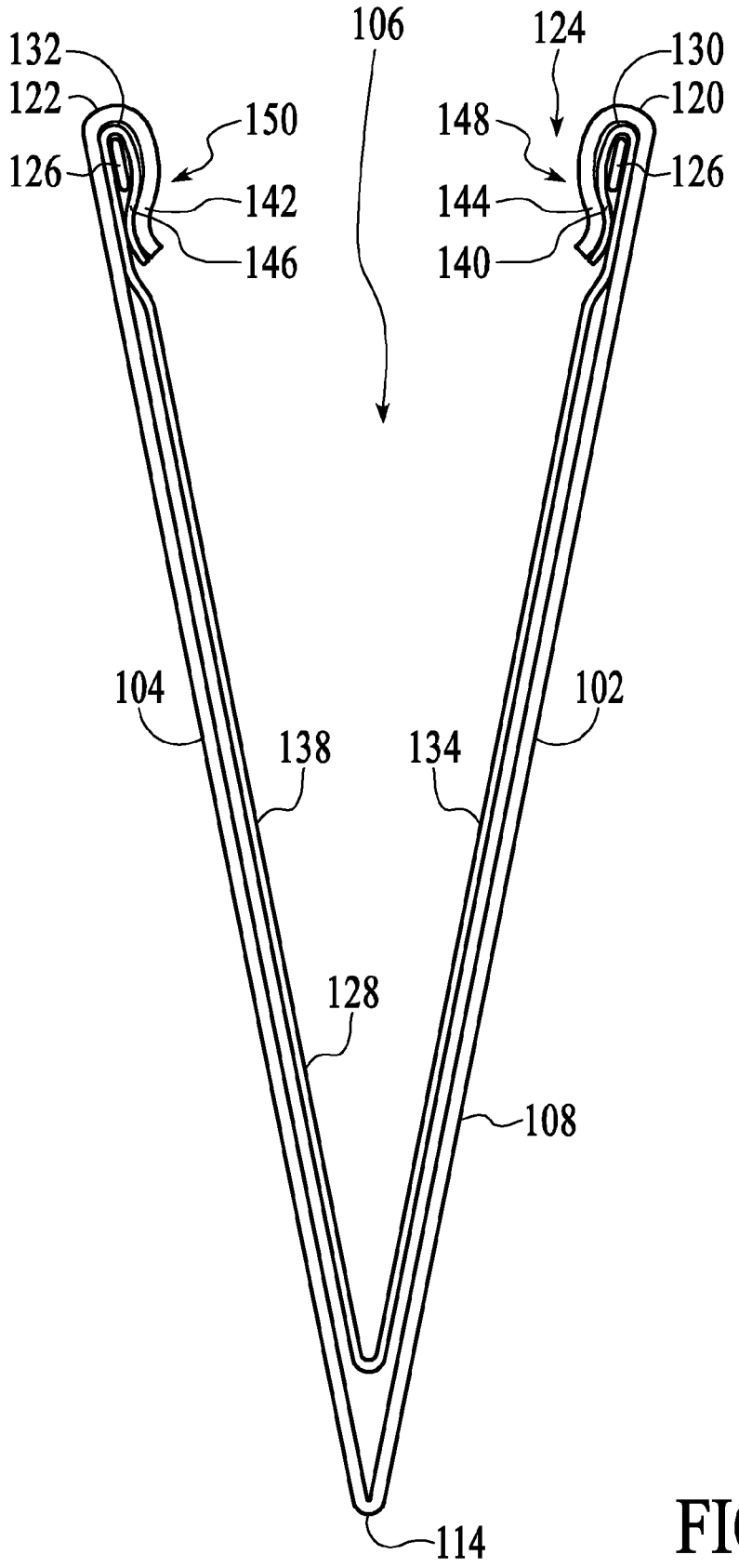
FIG. 2 is a cross-sectional view of the thermoplastic bag taken along line 2-2 of FIG. 1 and illustrating an outer bag and an inner bag and a draw tape accommodated in a hem.

To accommodate the draw tape 126, referring to FIG. 2, the top edges 120, 122 of the first and second sidewalls 102, 104 of the outer bag 108 corresponding to the periphery of the opening 124 may include respective first and second hem flaps 142, 144. FIG. 2 also shows an inner bag 128 with the top edges 130, 132 of the first and second sidewalls 134, 138 of the inner bag 128 corresponding to the interior of the opening 124 including respective first and second hem flaps 140, 146. The first hem flap 140 of the inner bag 128 may be folded back into the interior volume 106 and attached to the interior surface of the first sidewall 134 of the inner bag 128 and the first hem flap 144 of the outer bag 108 may be folded back into the interior volume 106 and attached to the exterior surface of the first hem flap 140 of the inner bag 128 to form a first hem 148 where the first hem 148 is sealed through four sidewall plies of material. Similarly, the second hem flap 146 of the inner bag 128 may be folded back into the interior volume 106 and attached to the interior surface of the second sidewall 138 of the inner bag 128 and the second hem flap 142 of the outer bag 108 may be folded back into the interior volume 106 and attached to the exterior surface of the second hem flap 146 of the inner bag 128 to form a second hem 150 where the second hem 150 is sealed through four sidewall plies of material. The hem flaps may be attached to the surfaces of the sidewalls by adhesive, heat seals or otherwise. In other embodiments, the hems may be formed by folding the hem flaps toward the exterior of the sidewalls and attaching them to the sidewall exterior surface, or the hems may be formed as separate elements that are attached to the sidewalls. The draw tape 126 is within the hems 148, 150 and adjacent to the first and second hem flaps 140, 146 of the inner bag 128, but not adjacent to the first and second hem flaps 142, 144 of the outer bag 108. The draw tape 126 passes through two or more notches 145, 147, where at the notches there may be two or more folded plies of material. In some embodiments, the sidewalls 102, 104 of the outer bag 108 may be lightly tacked or selectively laminated to the sidewalls 134, 138 of the inner bag 128. In some embodiments, the outer bag 108 is liquid impervious and the inner bag 128 is liquid pervious. The outer bag 108 may be of the same length or may be longer than the inner bag 128, as illustrated in FIG. 2.

Figure 3:
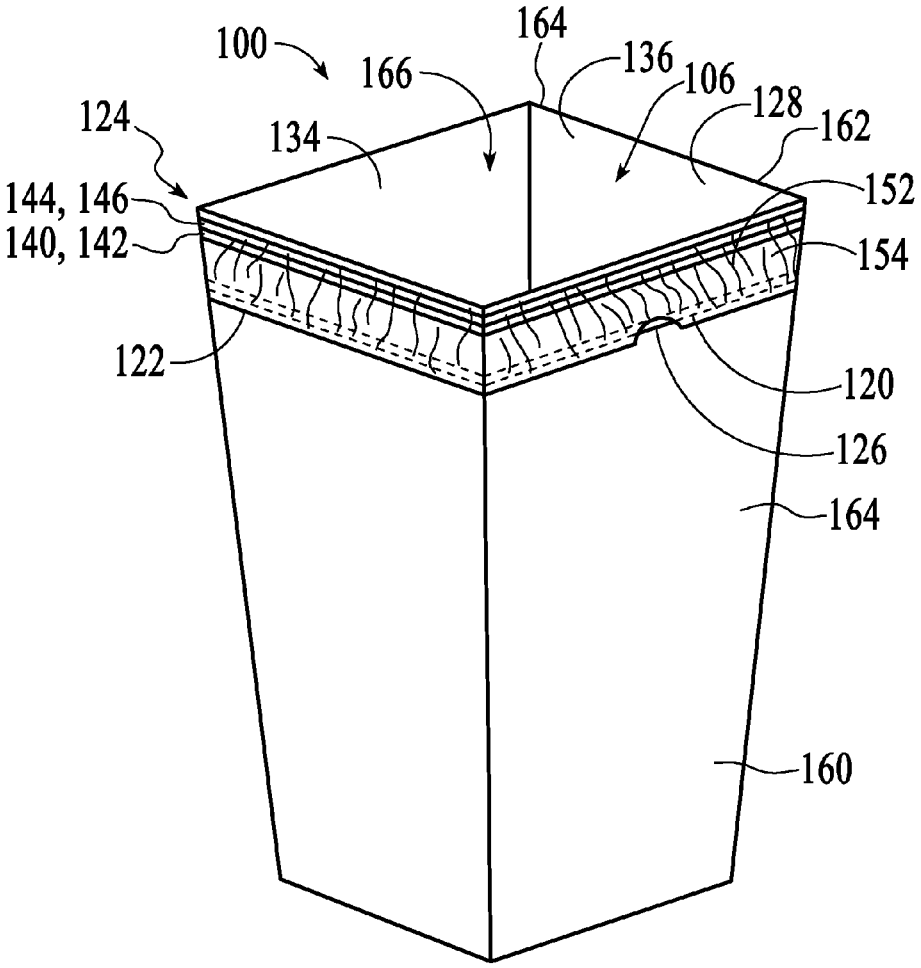
FIG. 3 is a top perspective view of the thermoplastic bag inserted in and retained to a refuse canister.

Thus, when inserting the bag 100 into a canister 160, as illustrated in FIG. 3, the draw tape 126 and the top edges 120, 122 including the draw tape 126 are folded over the upper rim 162 of the canister 160 to expose the interior surface 154 of the hem 152 and the outer bag hem flaps 142, 144 and the inner bag hem flaps 140, 146 on the outside surface 164 of the canister 160. The interior surface 154 of the hem 152 is formed from the first and second hem flaps 142, 144 of the outer bag 108 (FIG. 2). The interior 166 of the canister 160 is covered by the first and second sidewalls 134, 138 of the inner bag 128. Thus, the first and second hem flaps 142, 144 of the outer bag 108 are visible at the top of the outside surface 164 of the canister 160 and the inner bag 128 is visible on the interior 166 of the canister 160. The bag 100 is thereby positioned vertically with the canister 160 and its interior volume 106 readily exposed to receive trash. In the illustrated embodiment, the canister 160 is formed as an upright rectangular structure with a square cross section, but the bag is intended for use as a liner with trash canisters of any shape.

Referring to FIG. 4, there is illustrated a sealed side edge 110, 112 showing a side seal 116, 118 containing outer bag sidewalls 102, 104 and inner bag sidewalls 134, 138 in the sealed area. This allows the outer bag 108 and the inner bag 128 to interact along both the hem area (FIG. 2) and the side seal area (FIG. 4), while outer bag 108 and the inner bag 128 are free to move independently of one another in the middle area of the bag (FIG. 2).

Each sidewall ply of material of the outer bad and the inner bag may be a single layer or multi-layer, for example bi-layer, tri-layer, quad-layer, etc. In a suitable example shown in FIG. 5A, the film ply of either the outer bag or the inner bag may be a single layer 501 of film ply. In a suitable example in shown in FIG. 5B, the film ply of either the outer bag or the inner bag may be a bi-layer 502 and 503 of film ply. In a suitable example in shown in FIG. 5C, the film ply of either the outer bag or the inner bag may be a tri-layer 504, 505 and 506 of film ply. Multi-layer plies may be formed by co-extrusion. As described above, the film may include a plurality of thermoplastic layers. Besides, thermoplastic materials, adjuncts may also be included, as desired (e.g., pigments, slip agents, anti-block agents, tackifiers, or combinations thereof). The thermoplastic material of the films of one or more implementations can include, but are not limited to, thermoplastic polyolefins, including polyethylene, polypropylene, and copolymers thereof. Besides ethylene and propylene, exemplary copolymer olefins include, but are not limited to, ethylene vinylacetate (EVA), ethylene methyl acrylate (EMA) and ethylene acrylic acid (EAA), or blends of such olefins. Various other suitable olefins and polyolefins will be apparent to one of skill in the art.

In one example such as shown in FIG. 5C, either the outer bag, the inner bag, or both bags can be produced with first and second sidewalls having a coextruded three layer B:A:B structure, where the ratio of layers can be 20:60:20 and the nominal total thickness of film can be 0.40 mil. The exterior B layers can be comprised of a mixture of hexene LLDPE of density 0.918, and metallocene LLDPE of density 0.918. The interior A core layer can be comprised of a mixture of hexene LLDPE of density 0.918, butene LLDPE of density 0.918, reclaimed resin from trash bags, and colorant containing carbon black, resulting in a black colored film. In another example, either the outer bag, the inner bag, or both bags can be produced with first and second sidewalls having a coextruded three layer B:A:B structure, where the ratio of layers can be 20:60:20 and the nominal total thickness of film can be 0.40 mil. The exterior B layers can be comprised of hexene LLDPE of density 0.918, and metallocene LLDPE of density 0.918. The interior A core layer can be comprised of hexene LLDPE of density 0.918, metallocene LLDPE of density 0.918, butene LLDPE of density 0.918, reclaimed resin from trash bags, processing aide, colorant containing carbon black, and colorant containing white $TiO_2$, resulting in a grey colored film. In another example, the single ply, inner or outer bag is a coextruded three-layer B:A:B structure where the ratio of layers can be 15:70:15 and can be 0.4 mil thick. The core layer A can be a LLDPE material, and the outer layers B can include added $C_6$ olefin LLDPE. The LLDPE material used can have a MI of 1.0 and density of 0.920 g/cm$^3$. Where LLDPE material is used in single or multi-layered plies for the outer bag or the inner bag, LLDPE preferably represents greater than 50% of the overall thermoplastic material.

In at least one implementation of the present invention, the film can preferably include linear low density polyethylene. The term "linear low density polyethylene" (LLDPE) as used herein is defined to mean a copolymer of ethylene and a minor amount of an alkene containing 4 to 10 carbon atoms, having a density of from about 0.910 to about 0.926 g/cm$^3$, and a melt index (MI) of from about 0.5 to about 10. For example, one or more implementations of the present invention can use an octene co-monomer, solution phase LLDPE (MI=1.1; $\rho$=0.920). Additionally, other implementations of the present invention can use a gas phase LLDPE, which is a hexene gas phase LLDPE formulated with slip/AB (MI=1.0; $\rho$=0.920). One will appreciate that the present invention is not limited to LLDPE, and can include "high density polyethylene" (HDPE), "low density polyethylene" (LDPE), and "very low density polyethylene" (VLDPE). Indeed films made from any of the previously mentioned thermoplastic materials or combinations thereof can be suitable for use with the present invention.

Useful materials in the inventive films include but are not limited to thermoplastic polyolefins, including polyethylene and copolymers thereof and polypropylene and copolymers thereof. The olefin based polymers include the most common ethylene or propylene based polymers such as polyethylene, polypropylene, and copolymers such as ethylene vinylacetate (EVA), ethylene methyl acrylate (EMA) and ethylene acrylic acid (EAA), or blends of such polyolefins. Other examples of polymers suitable for use as films include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), ethylene-propylene rubber.

Other examples of polymers suitable for use as films in accordance with the present invention include elastomeric polymers. Suitable elastomeric polymers may also be biodegradable or environmentally degradable. Suitable elastomeric polymers for the film include poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), ethylene-propylene rubber, and combinations thereof.

Alternative to conventional flat extrusion or cast extrusion processes, a manufacturer can form the films using other suitable processes, such as, a blown film process to produce mono-layer, bi-layer, or multi-layered films. Optionally, the manufacturer can anneal the films. The extruder used can be of a conventional design using a die, which will provide the desired gauge. Some useful extruders are described in U.S. Pat. Nos. 4,814,135; 4,857,600; 5,076,988; 5,153,382; each of which are incorporated herein by reference in their entirety. Examples of various extruders, which can be used in producing the films to be used with the present invention, can be a single screw type modified with a blown film die, an air ring, and continuous take off equipment. In one or more implementations, a manufacturer can use multiple extruders to supply different melt streams, which a feed block can order into different channels of a multi-channel die. The multiple extruders can allow a manufacturer to form a multi-layered film with layers having different compositions.

Figure 6:
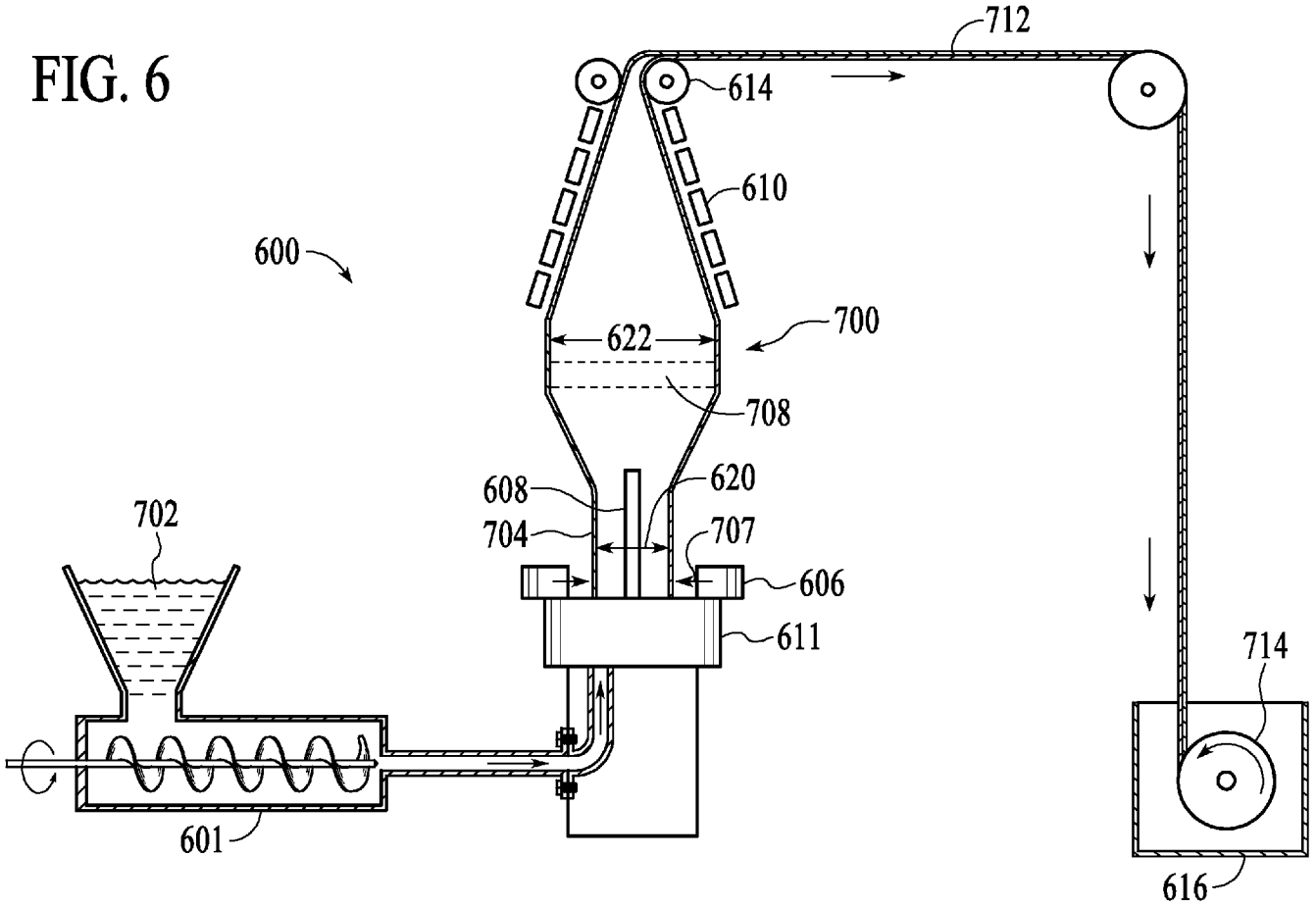
FIG. 6 shows a schematic sectional, side view of a blow molding extruder used to produce a blow-formed continuous film tube of polyethylene or other thermoplastic material.
Figure 7:
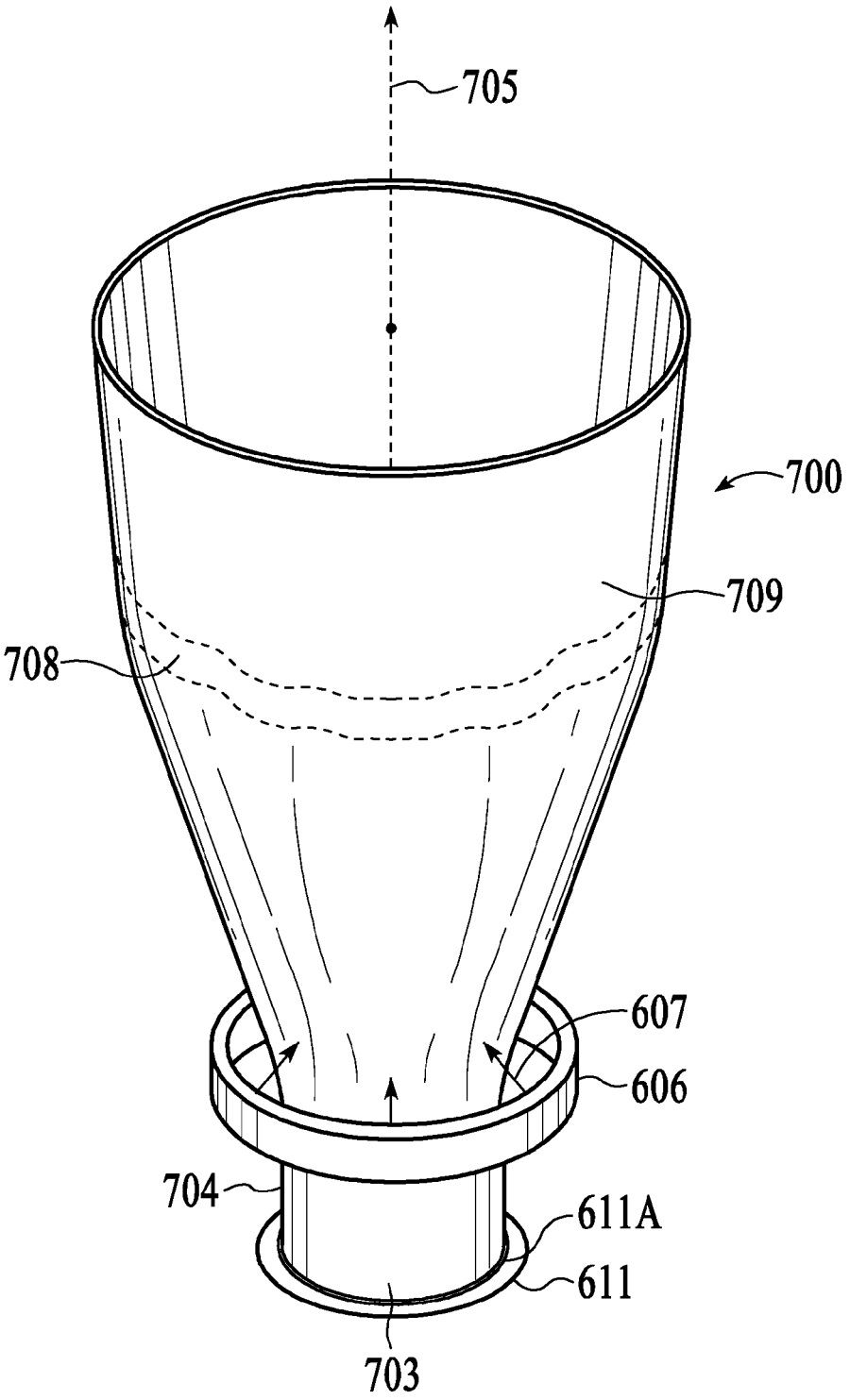
FIG. 7 shows a perspective view of a portion of the film tube formed in the extruder of FIG. 6.

FIG. 6 shows a schematic sectional, side view of a blown film extrusion system 600 used to produce a blown-formed continuous film tube 700 of polyethylene or other thermoplastic material. FIG. 7 shows a perspective view of a portion of the film tube 700 formed by the extrusion process 600 of FIG. 6. Processes for the manufacture of blown film tubes are generally known. Blown film extrusion processes are described, for example, in U.S. Pat. Nos. 2,409,521, 2,476,140, 2,634,459, 3,750,948, 4,997,616, 5,213,725, and 5,700,489.

In a blown film process as shown in FIGS. 6 and 7, the output die gap 611A can be an upright cylinder with a circular opening. Rollers 614 can pull molten plastic melt 704 upward away from the output die gap 611A. An air outlet 608 can force compressed air into the center of the extruded circular profile, creating a bubble. The air can expand the extruded circular cross section diameter 620 to form an expanded diameter 622. In some instances, the air is replenished and circulated within the bubble to improve the cooling of the film via conduits not shown in the figures. In addition, air is blown on the outside circumference of the film with an air ring 606 to provide cooling and aerodynamic support to the molten bubble. The ratio of the expanded diameter 622 to the extruded diameter 620 is called the "blow-up ratio." The blow-up ratio, processing conditions, and the particular thermoplastic resin can be varied to obtain the desired film properties. These film properties are different from those obtained from an extruded cast film process. In particular, we have found that the blown film process when used along with LLDPE resin is particularly suited to making very thin films suitable for a trash bag having an outer bag and an inner bag. When using a blown film process, the manufacturer can then collapse the film to double the plies of the film. Alternatively, the manufacturer can cut and fold the film, or cut and leave the film unfolded.

Referring to FIGS. 6 and 7 together, in a blown film extrusion system, molten plastic melt 702 is first created and pumped by an extruder 601 (FIG. 6). The plastic melt 702 is fed into an annular blowing head 611 that has a ring-shaped output die gap 611A, usually referred to as a "die gap", through which the plastic melt 702 flows.

In the blown film extrusion process, the plastic melt 702 is extruded from the output die gap 611A (FIG. 7) of the die 611 to form a molten bubble, some times referred to as a tubular stalk 704, that is thereafter expanded to fully form a continuous cylindrically shaped film tube 700 exiting and moving away from the output die gap 611. As shown in FIGS. 6 and 7, film tube 700 includes a tube central axis 705 along the length of film tube 700 and a tube outside surface 709 at the outside of the cylinder forming film tube 700. By blowing air into the inside of the moving tubular stalk 704 through a pressurizing pipe 608 (FIG. 6) within the interior of stalk 704, a pressure is produce inside the tubular stalk 704 that is higher than the external pressure outside the tubular stalk 704. The higher inside pressure causes the moving tubular stalk 704 to expand into the fully formed continuous cylindrical web of the film tube 700.

As shown, an annular shaped air ring cooler 606, circumscribing stalk 704, blows cooling air, as indicated by arrows 607 in FIG. 7, toward the stalk outside surface 703 of stalk 704 to rapidly cool and aerodynamically support the moving molten plastic melt 702 forming tubular stalk 704. By regulating the temperature of the cooling air 607 exiting air ring cooler 606 and other manufacturing parameters, a frost line region 708 is established circumferentially at a static location on the extruder 601. The frost line region 708 is the location beyond the air ring cooler 606 where the molten plastic melt 702 forming the film tube 700 solidifies through cooling as film tube 700 moves away from air ring cooler 606 along the direction of tube central axis 705. At this frost line region 708, film tube 700 no longer expands as it moves away from air ring cooler 606 since the molten plastic melt 702 forming film tube 700 has now completely solidified.

The continuous web of film tube 700 is collapsed at a collapsing frame 610 (FIG. 6) and subsequently formed into a flat web 712 (FIG. 6) at nip rollers 614 (FIG. 7). The flat web 712 is wound into a film tube roll 714 at a winder 616. The two flattened film layers of finished web 712 of film tube 700 are not, at this point in the process, separated but rather are wound as two overlapping film layers into two-ply tube rolls 714.

Figure 8:
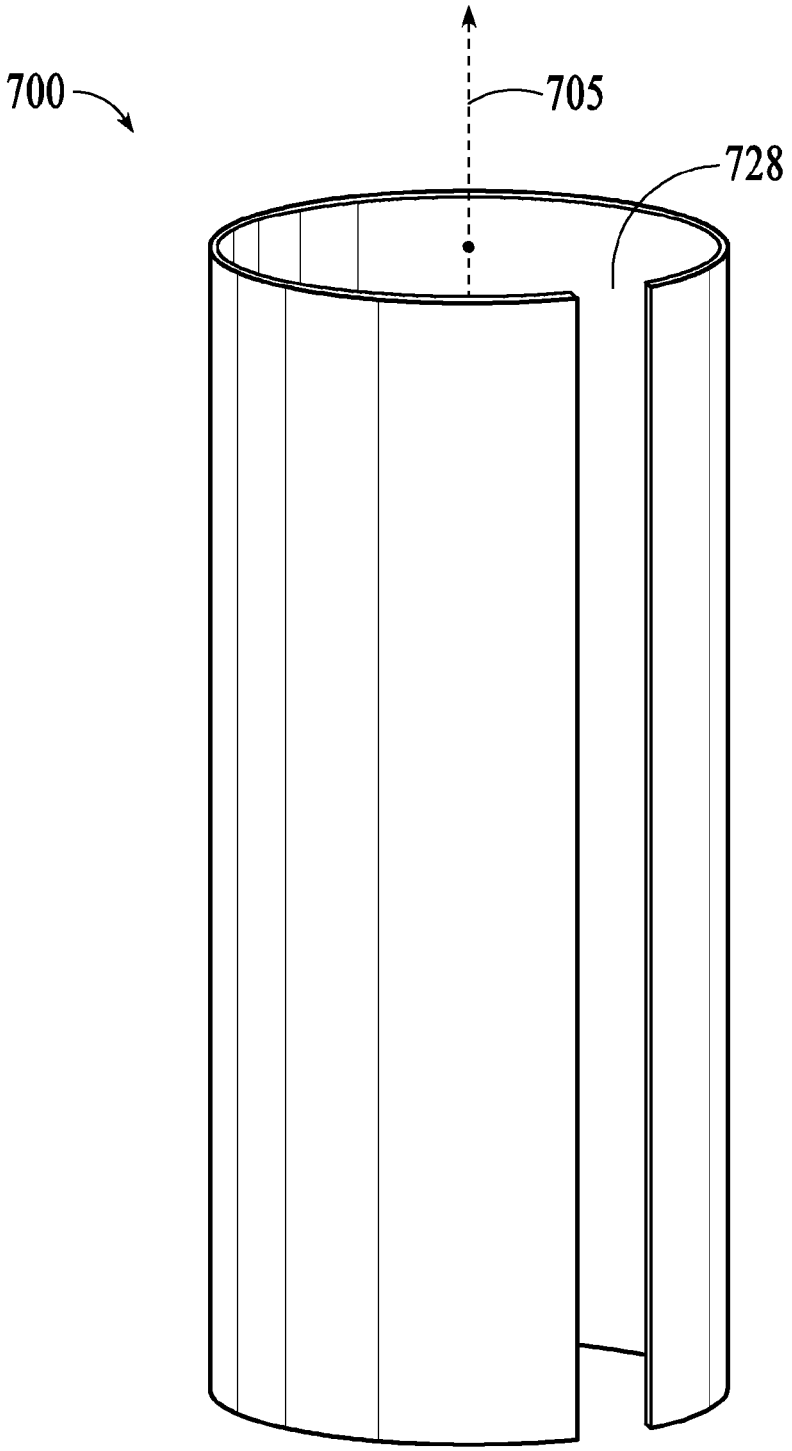
FIG. 8 shows a perspective view of the film tube of FIG. 7 slit in accordance with the principles of the present invention.

FIG. 8 shows a perspective view of a portion of the film tube 700 formed in the blown film extrusion process of FIG. 6 at a further stage of processing. Referring to FIGS. 6 and 8 together, in one embodiment film tube 700 has been unrolled from tube rolls 714 and slit axially in the direction of tube central axis 705 along the length of film tube 700 to form a single sheet of plastic film. As shown in FIG. 8, in one embodiment the film tube 700 has been slit in the profile of a straight line slit 728. Various well know means may by used to axially slit film tube 700. Once slit, film tube 700 is further processed to form bags in accordance with the principle of the present invention.

In another embodiment, film tube 700 is slit axially prior to winding into tube rolls 714. The continuous web of slit film tube 700 is wound into a film tube roll 714 at a winder 616. The slit single film layer of the finished web of film tube 700 is wound as a single-ply web 714 for later processing.

In another embodiment, the flattened film tube 712 is slit to create webs that have a folded edge and a slit edge, said webs commonly referred to as a C-folded web. Each continuous C-folded web is directed along a path to be wound into a film roll on a separate winder. The slit C-folded webs of the finished web of tube 700 are wound as C-folded webs into rolls 714 for later processing. It may be advantageous to slit additional webs from the flattened film tube 712 and to direct these webs through folding stations to create wound C-folded webs.

The films of one or more implementations of the present invention can have a starting gauge between about 0.0001 inches to about 0.0015 inches, suitably from about 0.0002 inches to about 0.00125 inches, suitably in the range of about 0.0003 inches to about 0.0009 inches, and suitably from about 0.0004 inches and about 0.0006 inches. Additionally, the starting gauge of films of one or more implementations of the present invention may not be uniform. Thus, the starting gauge of films of one or more implementations of the present invention may vary along the length and/or width of the film. The gauge of the outer bag may be thicker, thinner, or the same as the gauge of the inner bag.

The table below shows typical physical properties in the machine direction (MD) and the transverse direction (TD) for cast film and blown film of 0.0008 to 0.0010 inches from LLDPE thermoplastic.

LLDPE Typical Values

| Film Properties | | Cast | Blown | Units | Test Method |
|---|---|---|---|---|---|
| Tensile Strength at Yield | MD | 8.4 | 9.3 | MPa | ASTM D882 |
| | TD | 7.7 | 10 | MPa | ASTM D882 |
| Tensile Strength at Break | MD | 70 | 60 | MPa | ASTM D882 |
| | TD | 38 | 48 | MPa | ASTM D882 |
| Elongation at Break | MD | 340 | 500 | % | ASTM D882 |
| | TD | 790 | 840 | % | ASTM D882 |
| 1% Secant Modulus | MD | 120 | 200 | MPa | ASTM D882 |
| | TD | 140 | 240 | MPa | ASTM D882 |
| Dart Drop Impact | MD | 80 | 140 | g | ASTM D1709A |
| Elmendorf Tear Strength | MD | 300 | 440 | g | ASTM D1922 |
| | TD | 750 | 740 | g | ASTM D1922 |

As can be seen, the blown film typically has much higher MD tear, MD tensile elongation at break, and dart drop impact resistance, than a film made from the same material but by the cast film process, making the blown film more suitable as a trash bag film. It also has higher 1% secant modulus (stiffness), both MD and TD. The cast film has a higher MD tensile strength at break owing to the predominantly MD orientation induced by the cast extrusion process compared to the blown film process.

A film of LLDPE having a starting gauge of 0.0006 inches was produced by a blown film process. At a film blow-up ratio of 2.0, the film had a MD Tear of 243 gm, a TD Tear of 660 gm, and a impact resistance of 1.54 In-$Lb_f$. At a film blow-up ratio of 3.0, the film had a MD Tear of 323 gm, a TD Tear of 536 gm, and an impact resistance of 3.32 In-$Lb_f$. By comparison, a cast extruded film would have a MD Tear of <100 gm and a TD Tear of 800 to 1000 gm. When relatively thin films of LLDPE or of greater than 50% LLDPE were produced by the blown film process and were converted into a trash bag having an outer bag and an inner bag, the trash bag had surprisingly good performance compared to a similar one ply bag having the thickness equivalent to the combined thicknesses of the inner and outer bags. Not wanting to be bound by theory, we believe the improved performance is related to an additive form of impact resistance each layer contributes to the overall structure. This additive resistance is realized only if the film has an orientation balance that can be achieved by the blown film process and not the cast film process, as indicated by the ratio of MD to TD tears of the films. Films made by the blown film process will have a typical MD/TD tear ratio of 0.25 to 0.70 whereas cast films have a MD/TD ratio less than 0.25. We believe that a trash bag having an outer bag and an inner bag realizes the performance benefits only if the film is extruded by the blown film process and has an MD/TD tear ratio of the individual plies greater than 0.25.

It may be useful and beneficial to combine two or more folded films by inserting one folded film into another folded film such that the folded edges of the composed films coincide or align and the open edges of the folded films coincide. Such films can be used to form a trash bag with an outer bag and an inner bag with no seam along the bottom of the trash bag. Instead of a seam, the fold of the films of the outer bag and the inner bag can form the bottom of the trash bag.

Figure 9:
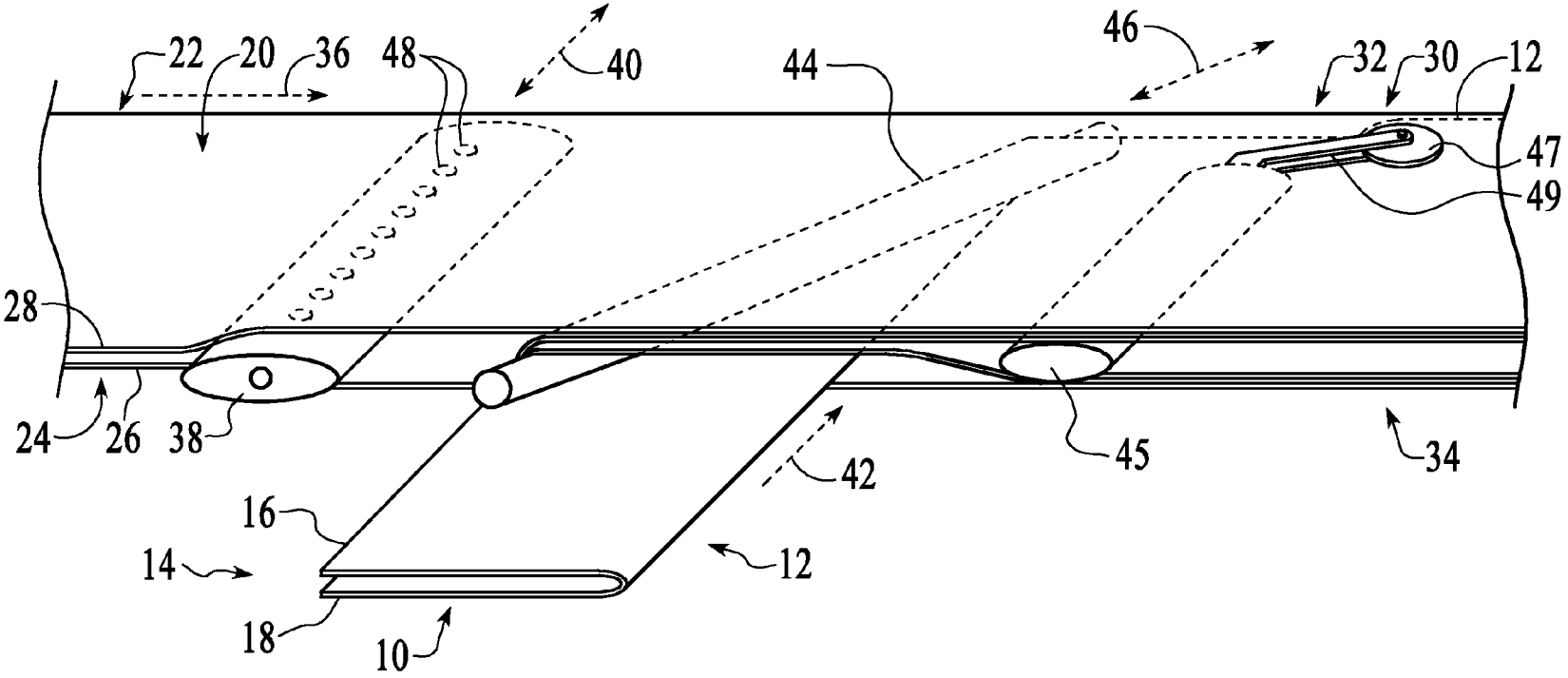
FIG. 9 illustrates a process and apparatus for inserting a folded film into another folded film in accordance with an implementation of the present invention.

Referring now to FIG. 9, there is illustrated one exemplary process and apparatus for inserting a folded film into another folded film in accordance with an implementation of the present invention. In particular, FIG. 9 illustrates an insertion process that inserts one folded film 10 into another folded film 20 and produces a multi-ply composition 30. As illustrated, the folded film 10 can comprise a folded edge 12, an open edge 14, a first half 16, and a second half 18. Similarly, the folded film 20 can comprise a folded edge 22, an open edge 24, a first half 26, and a second half 28. Thus, as shown, each of the folded films 10, 20 can comprise a "c," "j," or "u" configuration. As such, the folded films 10, 20 may be referred to herein as c-folded, j-folded films, or u-folded films. C-folded films can comprise films that are symmetrical about their folded edge, while j- or u-folded films can comprise films that are not symmetrical about their folded edge (i.e., one of the halves extend farther than the other).

FIG. 9 also depicts the resulting multi-ply composite folded film 30. The resulting multi-ply composite folded film 30 is comprised of folded film 10 which is inserted within folded film 20. In particular, the folded film 10 lies between the first half 26 and the second half 28 of folded film 20. The resulting multi-ply composite folded film 30 has a folded edge 32 and an open edge 34. The folded edges 12 and 22 of folded films 10 and 20 coincide with the folded edge 32 of the resulting multi-ply composite folded film 30. Correspondingly, the open edges 14 and 24 of folded films 10 and 20 coincide with the open edge 34 of the resultant multi-ply composite folded film 30.

As explained in greater detail below, the folded film insertion processes of the present invention can produce a multi-ply composite folded film which may comprise properties of both folded film 10 and folded film 20. Such combination of properties of two composed folded films may have beneficial effects in the resulting composite and for products, such as trash or food bags, which are manufactured with the composite folded films. Additionally, the processes and apparatus disclosed herein may provide benefits in the manufacturing process for producing a composite folded film by reducing the time, floor space, and complexity of inserting one folded film into another folded film. The reduction in the time, floor space, and complexity for inserting one folded film into another folded film, in turn, can result in efficiencies and cost savings for the production of trash bags having an inner bag and an outer bag.

To produce the multi-ply composite folded film 30, a manufacturer can advance the folded film 20 in a first direction of travel 36. In one or more implementations the first direction of travel 36 may be parallel to a machine direction, or in other words, the direction in which the folded film 20 was extruded. While traveling in the first direction of travel 36, the manufacturer can separate the first half 26 from the second half 28 of the folded film 20. For example, the folded film 20 can pass about a spreader bar 38. The spreader bar 38 can open the folded film 20. For example, FIG. 9 illustrates that the spreader bar 38 can separate the first half 26 from the second half 28 of the folded film 20, thereby creating a space between the first and second halves 26, 28. In particular, the first half 26 of the folded film 20 can pass on one side of the spreader bar 38 and the second half 26 of the folded film 20 can pass on an opposing side of the spreader bar 38.

The spreader bar 38 can be made of cast and/or machined metal, such as, steel, aluminum, or any other suitable material. Optionally, the spreader bar 38 can be coated with a material such as a rubber or urethane. Still further, the spreader bar 38 can optionally have an air bearing assist or plasma coating to reduce friction. The spreader bar 38 can extend in a direction 40. In one or more implementations, the direction 40 can be transverse or perpendicular to the first direction of travel 36. Thus, in one or more implementations the spreader bar 38 can extend in a direction transverse to the machine direction. The spreader bar 38 can have any configuration that allows for separating of the first and second halves 26, 28 of the folded film 20. For instance, as shown by FIG. 9 the spreader bar 38 can have tapered leading edge. In alternative implementations, the spreader bar 38 can have a cylindrical or other shape.

FIG. 9 further illustrates that a manufacturer can advance the folded film 10 in a second direction of travel 42. The second direction of travel 42 can be non-parallel to the first direction of travel 36. For example, in one or more implementations the second direction of travel 42 can be transverse or perpendicular to the first direction of travel 36. The manufacturer can further insert the folded film 10 between the separated halves 26, 28 of folded film 20. For example, the manufacturer can advance the folded film 10 in the second direction of travel 42 between the first half 26 and the second half 28 of folded film 20.

Once within the folded film 20, the manufacturer can redirect the folded film 10 from the second direction of travel 42 to the first direction of travel 36. In particular, the folded film 10 can change directions from the second direction of travel 42 to the first direction of travel 36 while between the first and second layers 26, 28 of the folded film 20. For example, the folded film 10 can pass about a direction change bar or roller 44. The direction change bar 44 can change the direction of travel of the folded film 10. More specifically, the folded film 10 can pass initially on a first side of the direction change bar 44 and then pass about the direction change bar 44 so the folded film 10 leaves a second opposing side of the direction change bar 44.

One will appreciate in light of the disclosure herein that the direction change bar 44 can comprise a number of different configurations. For example, FIG. 9 illustrates that the direction change bar 44 can comprise a cylinder. In alternative implementations, the direction change bar 44 may be a flat bar with a tapered edge, or may be a roller with a rolling direction to accommodate the direction of travel of folded film 10. Thus, in the implementation shown in FIG. 9, the direction change bar 44 can rotate in a clockwise direction. The direction change bar 44 can be made of cast and/or machined metal, such as, steel, aluminum, or any other suitable material. Optionally, the direction change bar 44 can be coated with a material such as a rubber or urethane. Still further, the direction change bar 44 can optionally have an air bearing assist or plasma coating to reduce friction.

FIG. 9 illustrates that the direction change bar 44 can reside in plane with the spreader bar 38. The in-plane configuration of the spreader bar 38 and the direction change bar 44 can allow the direction change bar 44 to change the direction of the folded film 10 while within the folded film 20. FIG. 9 further illustrates that the direction change bar 44 can extend in a direction 46. The direction 46 can extend at an acute angle relative to direction 40. For example, the direction 46 can extend at an angle of 45 degrees relative to direction 40. In other words, the direction change bar 44 can extend at an angle of 45 degrees relative to the spreader bar 38. Thus, as folded film 10 passes over direction change bar 44, direction change bar 44 can effect a change in direction of travel of folded film 10 of 90 degrees. In other words, after passing about the direction change bar 44, folded film 10 can travel in a direction perpendicular to the second direction of travel 42.

After folded film 10 passes over direction change bar 44, folded film 10 is then situated between the first and second layers 26, 28 of folded film 20 (i.e., folded film 10 has been inserted into folded film 20) resulting in multi-ply composite folded film 30. As previously mentioned, multi-ply composite folded film 30 has a folded edge 32 and an open edge 34. The folded edges 12 and 22 of folded films 10, 20 coincide with the folded edge 32 of the resulting multi-ply composite folded film 30. Correspondingly, the open edges 14 and 24 of folded films 10, 20 coincide with the open edge 34 of the resultant multi-ply composite folded film 30.

One or more implementations can further include an applicator that applies an additive to one or more of the halves 16, 18, 26, 28 of the folded films 10, 20. For example, FIG. 9 illustrates that the spreader bar 38 can have an integrated applicator. The integrated applicator can include a plurality of openings 48 that dispense or spray an additive on the inside surface of the folded film 20 as the folded film 20 passes about the spreader bar 38. As explained in greater detail below, in alternative implementations a separate applicator can reside between the spreader bar 38 and the direction change bar 44.

In any event, the applicator can apply an additive to one or more of the folded films 10, 20. Such additives can comprise, oils, fragrances, or other additives. For example, in one or more implementations the applicator can FIG. 9 illustrates a c-folded film 10 being inserted within another c-folded film 20. In one or more implementations the process and apparatus described in relation to FIG. 9 can be duplicated to combine three or more folded films or one or more folded films with one or more mono-ply film. For example, in one or more implementations another spreader bar similar to the spreader bar 38 can separate the first halves 16, 26 from the second halves 18, 28 of the multi-ply composite folded film 30. A manufacturer can then direct an additional film (either a mono-ply film or another folded film) in the second direction of travel 42. The process can then include inserting the additional film between the first halves 16, 26 and the second halves 18, 28 of the folded films 10, 20. Once within the first and second halves, the process can include redirecting the third film from the second direction of travel 42 into the first direction of travel 36. In particular, the third film can pass about a direction change bar similar to direction change bar 44.

In addition to the foregoing, one or more implementations can further include abutting the folded edge 12 of the folded film 10 against the folded edge 22 of the folded film 20. For example, FIG. 9 shows that once the folded film 10 is inserted within the folded film 20, the manufacturer can separate the first half 16 from the second half 18 of the folded film 10. For example, the folded film 10 can pass about a crease bar 45. The crease bar 45 can open the folded film 10. For example, FIG. 9 illustrates that the crease bar 45 can separate the first half 16 from the second half 18 of the folded film 10, thereby creating a space between the first and second halves 16, 18. In particular, the first half 16 of the folded film 10 can pass on one side of the crease bar 45 and the second half 16 of the folded film 10 can pass on an opposing side of the crease bar 45.

The crease bar 45 can be made of cast and/or machined metal, such as, steel, aluminum, or any other suitable material. Optionally, the crease bar 45 can be coated with a material such as a rubber or urethane. Still further, the crease bar 45 can optionally have an air bearing assist or plasma coating to reduce friction. The crease bar 45 can extend in a direction 40. The crease bar 45 can have any configuration that allows for separating of the first and second halves 16, 18 of the folded film 10. For instance, as shown by FIG. 9, the crease bar 45 can have tapered leading edge. In alternative implementations, the crease bar 45 can have a cylindrical or other shape.

The end of the crease bar 45 can include a wheel 47. In one or more implementations an arm 49 can position the wheel 47 down line from the crease bar 45. In alternative implementations, the wheel 47 can be in line with the crease bar 45 or on a separate bar down line from the crease bar 45. In any event, the wheel 47 can reside between the first and second halves 16, 18 of the folded film 10 separated by the crease bar 45. The wheel 47 can rotate and urge the folded edge 12 of the folded film 10 toward the folded edge 22 of the folded film 20. For example, in one or more implementations the wheel 47 can push or otherwise position the folded edge 12 of the folded film 10 against the folded edge 22 of the folded film 20.

Optionally, the wheel 47 can be coated with a material such as a rubber or urethane. Still further, the wheel 47 can optionally have an air bearing assist or plasma coating to reduce friction. In one or more implementations the wheel 47 can be configured to ensure that it does not rip or otherwise tear either of the folded films 10, 20. For example, the wheel 47 can be spring-loaded. Alternatively, or additionally, sensors can monitor the force the wheel 47 exerts on the folded films 10, 20. An actuator can automatically adjust one or more of the position of the wheel 47, the speed of the wheel 47, or other parameters to in response to the sensors to reduce the likelihood or prevent the wheel 47 from damaging the films.

FIG. 9 depicts an implementation wherein folded film 10 and folded film 20 arrive at the process and apparatus in perpendicular directions. In order to reduce manufacturing space, in one or more implementations folded film 10 and folded film 20 can arrive in directions other than perpendicular directions. For example, FIG. 10 illustrates an apparatus and method for inserting a folded film within another folded film in which the folded films 10, 20 both begin the process by advancing in the first direction of travel 36.

Figure 10:
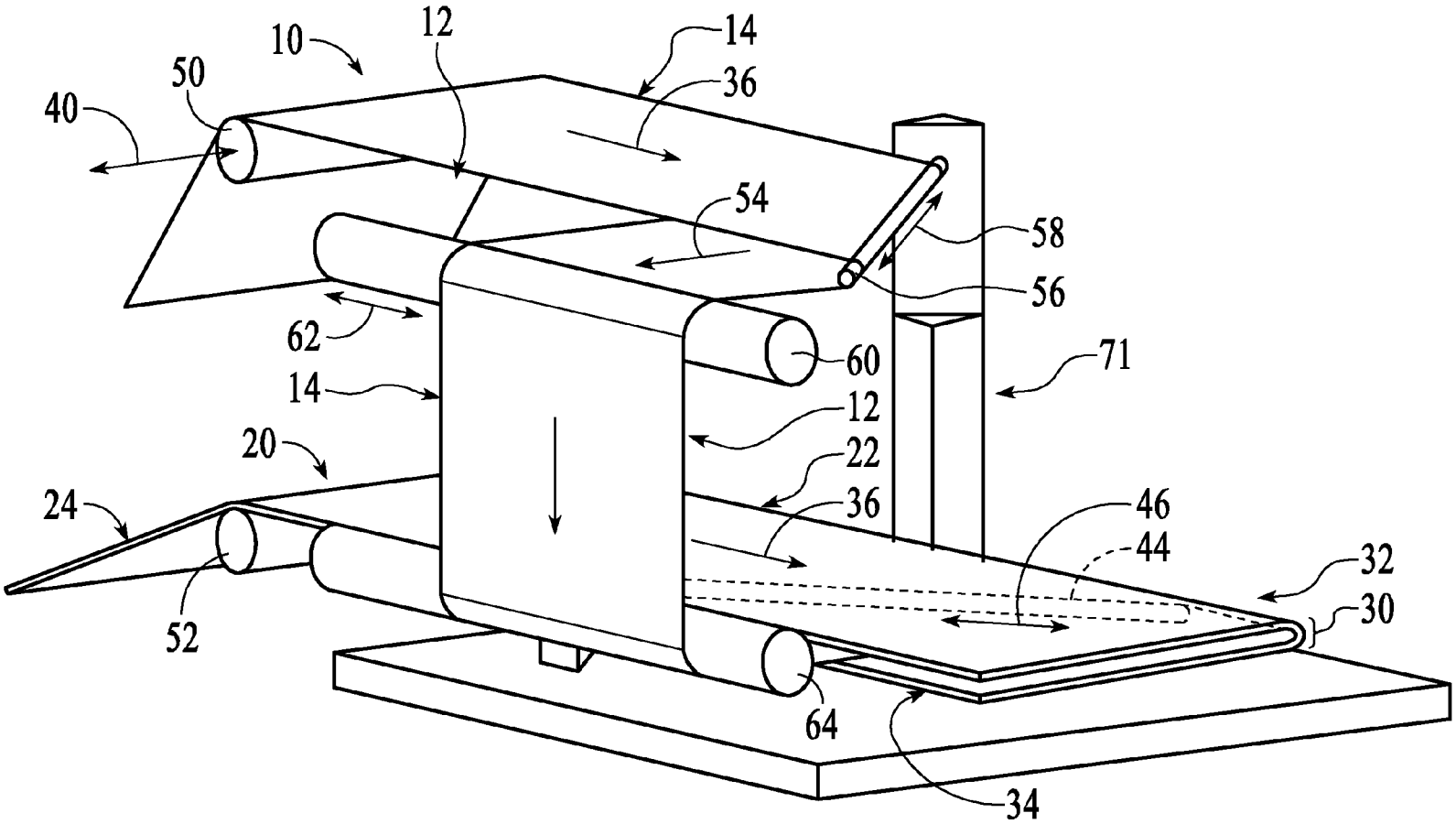
FIG. 10 illustrates another process and apparatus for inserting a folded film into another folded film in accordance with an implementation of the present invention.

As shown by FIG. 10, a guide roller 50 can direct the folded film 10 in the first direction of travel 36. Similarly, an additional guide roller 52 can direct the folded film 20 in the first direction of travel 36. Each of the guide rollers 50, 52 can extend in direction 40. The guide rollers 50, 52 can each have a generally cylindrical shape. The guide rollers 50 and 52 may be made of cast and/or machined metal, such as, steel, aluminum, or any other suitable material. The rollers 50 and 52 can rotate in a corresponding direction about parallel axes of rotation.

Guide roller 50, and thus folded film 10, can reside out of plane with guide roller 52, and thus folded film 20. For example, FIG. 10 illustrates that guide roller 50 can reside vertically above guide roller 52. One will appreciate that running folded films 10, 20 vertically on top of each other can reduce the foot print of the folded film combining apparatus. In alternative implementations, the guide roller 50, and thus folded film 10, can reside in the same plane with guide roller 52, and thus folded film 20.

After passing from the roller 50, the manufacturer can redirect the folded film 10 from the first direction of travel 36 to a third direction of travel 54. In particular, the folded film 10 can change directions from the first direction of travel 36 to the third direction of travel 54 by passing about a direction change bar or roller 56. The direction change bar 56 can change the direction of travel of the folded film 10 in a manner similar to that of direction change bar 44. Furthermore, direction change bar 56 can have a similar configuration to that of direction change bar 44. More specifically, folded film 10 can pass initially on a first side of the direction change bar 56 and then pass about the direction change bar 56 so folded film 10 leaves a second opposing side of the direction change bar 56.

FIG. 10 illustrates that the direction change bar 56 can reside in plane with the guide roller 50. Furthermore, the direction change bar 56 can reside out of plane with the direction change bar 44. For example, FIG. 7 illustrates that the direction change bar 56 can reside vertically above direction change bar 44.

FIG. 10 further illustrates that the direction change bar 56 can extend in a direction 58. The direction 58 can extend at an acute angle relative to the direction 40. For example, the direction 58 can extend at an angle of 45 degrees relative to the direction 40. In other words, the direction change bar 56 can extend at an angle of 45 degrees relative to the guide roller 50. In one or more implementations, the direction change bar 56 can extend in a direction 58 perpendicular to the direction 46 in which the direction change bar 44 extends. In any event, as folded film 10 passes over direction change bar 56, direction change bar 56 can effect a change in direction of travel of folded film 10 such that folded film 10 after passing about the direction change bar 56 travels in a direction perpendicular to the second direction of travel 36.

One or more orientation rollers can then direct the folded film 10 to the same plane as the folded film 20. For example, FIG. 10 illustrates that an orientation roller 60 can redirect the folded film 10 from a plane to a perpendicular plane. In particular, orientation roller 60 can redirect the folded film 10 from traveling in a horizontal plane to a vertical plane. The orientation roller 60 can extend in a direction 62 perpendicular to direction 40. Additionally, the orientation roller 60 can lie in the same plane as the direction change bar 56.

After passing from the orientation roller 60, the folded film 10 can pass about another orientation roller 64. Orientation roller 64 can redirect the folded film 10 from a plane to a perpendicular plane. In particular, orientation roller 64 can redirect the folded film 10 from traveling in a vertical plane to a horizontal plane. As shown by FIG. 10, orientation roller 64 can direct the folded film 10 into the second direction of travel 42. The orientation roller 64 can extend in direction 62. Additionally, the orientation roller 64 can lie in the same plane as the direction change bar 44.

The manufacturer can then insert the folded film 10 between the separated halves 26, 28 of folded film 20 as described above. Once within the folded film 20, the manufacturer can redirect the folded film 10 from the second direction of travel 42 to the first direction of travel 36. In particular, folded film 10 can pass about the direction change bar or roller 44 as described above. After folded film 10 passes over direction change bar 44, folded film 10 is then situated between the first and second layers 26, 28 of folded film 20 (i.e., folded film 10 has been inserted into folded film 20) resulting in multi-layer composite folded film 30.

As shown by FIG. 10, the folded edge 12 and open edge 14 of folded film 10 can change sides within the apparatus and during the process. As folded film 10 travels in the first direction of travel 36, folded edge 12 is at the "front" of FIG. 10 and open edge 14 is at the "back" of FIG. 10. As folded film 20, on the other hand, travels in the first direction of travel 36, folded edge 22 is at the "back" of FIG. 10 and open edge 24 is at the "front" of FIG. 10. Thus, the folded film 10 and the folded film 20 can enter the apparatus in opposing orientations. By passing about orientation rollers 60, 64 and direction change bar 44, the open edge 14 of folded film 10 can change to the "front" of FIG. 10 and the folded edge 12 can change to the "back" of FIG. 10. As multi-layer composite folded film 30 emerges from the apparatus and process, folded edge 12 of folded film 10 is coincident with folded edge 22 of folded film 20 and open edge 14 of folded film 10 is coincident with open edge 24 of folded film 20.

The system and devices of FIG. 10 do not include the crease bar 45 and wheel 47. One will appreciate in light of the disclosure herein, that the crease bar 45 and wheel 47 can be added to the systems and devices of FIG. 10 and/or any of the other devices, systems, and methods described herein. For example, in one or more implementations the system and devices of FIG. 10 can include a crease bar 45 and wheel 47 positioned down line from the direction change bar 44.

Figure 11:
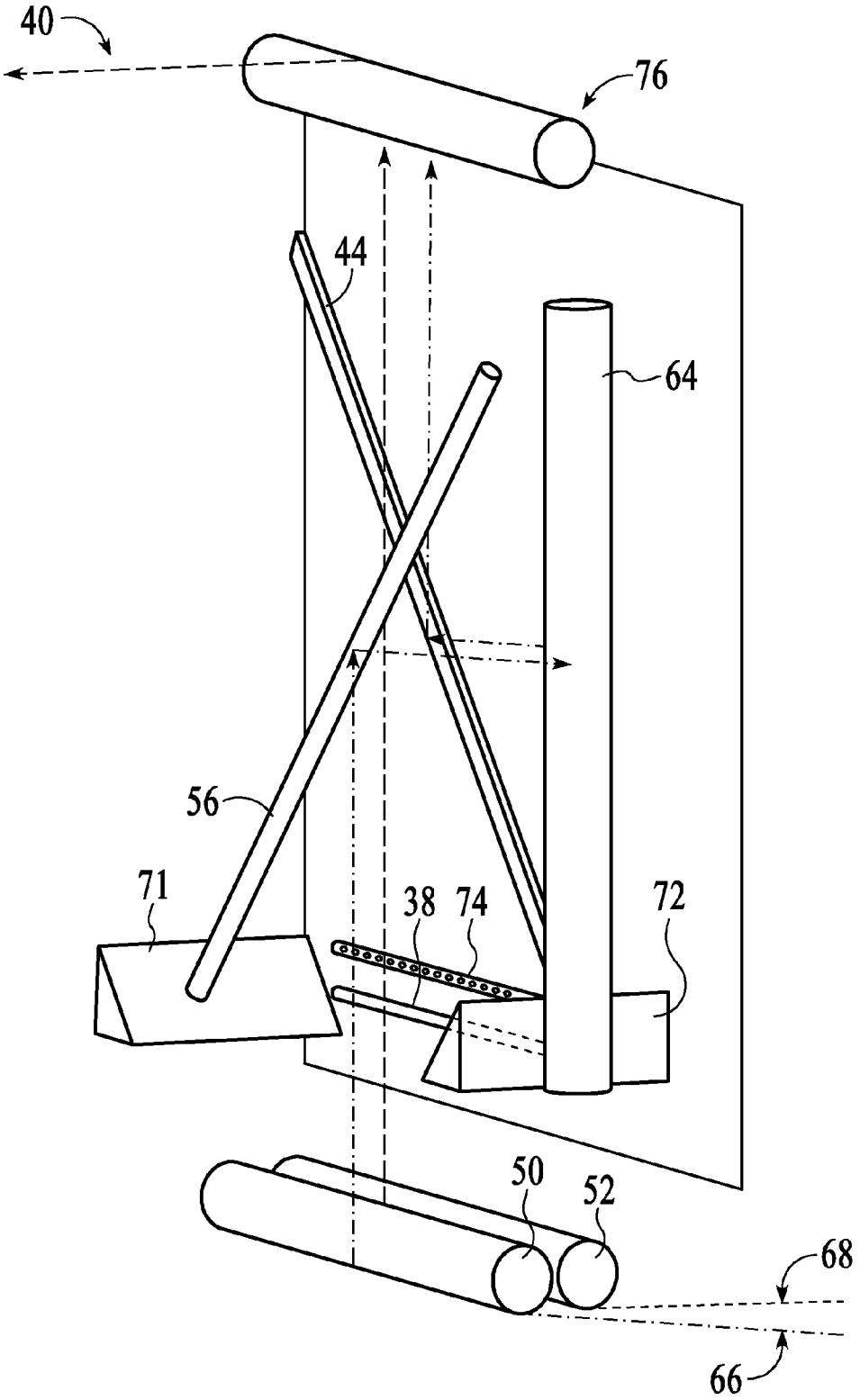
FIG. 11 illustrates another process and apparatus for inserting a folded film into another folded film in accordance with an implementation of the present invention.

FIG. 11 illustrates another implementation of an apparatus for inserting a first folded film within a second folded film. The apparatus of FIG. 11 is similar to that of FIG. 10 albeit positioned vertically. One will appreciate in light of the disclosure herein that the vertical orientation of the apparatus of FIG. 11 can further reduce the footprint of the apparatus and save manufacturing space. As shown by FIG. 11, in one or more implementations the spreader bar 38 direction change bar 44, guide roller 52, and orientation roller 64 are positioned in the same vertical plane. The direction change bar 44 and guide roller 50 are positioned in a second vertical plane horizontally offset from the first vertical plane.

FIG. 11 omits folded film 10 and folded film 20 in order to make the depicted components more readily visible and understandable. Line 66 illustrates the path of folded film 10 and line 68 illustrates the path of folded film 20. Line 70 on the other hand illustrates the path of multi-layer composite folded film 30.

FIG. 11 illustrates guide rollers 50 and 52 which receive folded film 10 and folded film 20, respectively. Guide roller 50 can direct folded film 10 along path 66 to direction change bar 56. Guide roller 60 can direct folded film 20 along path 68 to spreader bar 38. The apparatus can further include supports or posts 71, 72 which support one or more of the rollers or bars 38, 44, 56, 74. For example, FIG. 11 illustrates that post 71 can support direction change bar 56. Similarly, post 72 can support spreader bar 38, direction change bar 44, and applicator 74.

As previously alluded, one or more implementations can include an applicator positioned between spreader bar 38 and direction second change bar 38. For example, FIG. 11 illustrates an applicator 74 positioned in line and between spreader bar 38 and direction change bar 44. Similar to the integrated applicator in the spreader bar of FIG. 6, the applicator 74 can apply an additive to one or more of the halves 16, 18, 26, 28 of the folded films 10, 20. Such additives can comprise, oils, fragrances, or other additives In alternative implementations, the apparatus can include one or more applicators that apply an additive to the folded film 10. For example, a pair of applicators can extend above and below the folded film 10 and spray an additive on the outer surface of the folded film 10. In one or more implementations the apparatus can include such applicators between the orientation roller 64 and direction change bar 44.

As illustrated by FIGS. 9-11, it is possible that one or more implementations of the present invention may comprise some, all, or additional components as depicted in FIGS. 9-11. For example, FIG. 11 illustrates that orientation roller 60 may be omitted. In particular, orientation roller 64 can receive the folded film 10 after the folded film 10 leaves the direction change bar 56. Orientation roller 64 can then direct folded film to direction change bar 44.

In yet additional implementations, one or more orientation rollers and direction change bars can transition folded film 20 to the same plane as folded film 10. This is in contrast to FIG. 10 which shows one or more orientation rollers and direction change bars transitioning folded film 10 to the same plane as folded film 20. Such variations and alternative configurations are consistent with and are contemplated by the present invention. Further, such alternative configurations can accommodate various sizes of apparatus conforming to the present invention and accommodate the apparatus and/or process being employed in distinct and various situations. Accordingly, the components and descriptions herein should not be read as limitations and all variations and embodiments consistent with this description shall be considered within the scope of the invention.

By inserting one folded film into another folded film, a multi-ply composite folded film may be produced which comprises the beneficial but possibly distinct properties of each of the folded films of the multi-ply composite folded film. Trash bags and food storage bags may be particularly benefited by the multi-ply composite folded film of the present invention.

Figure 12:
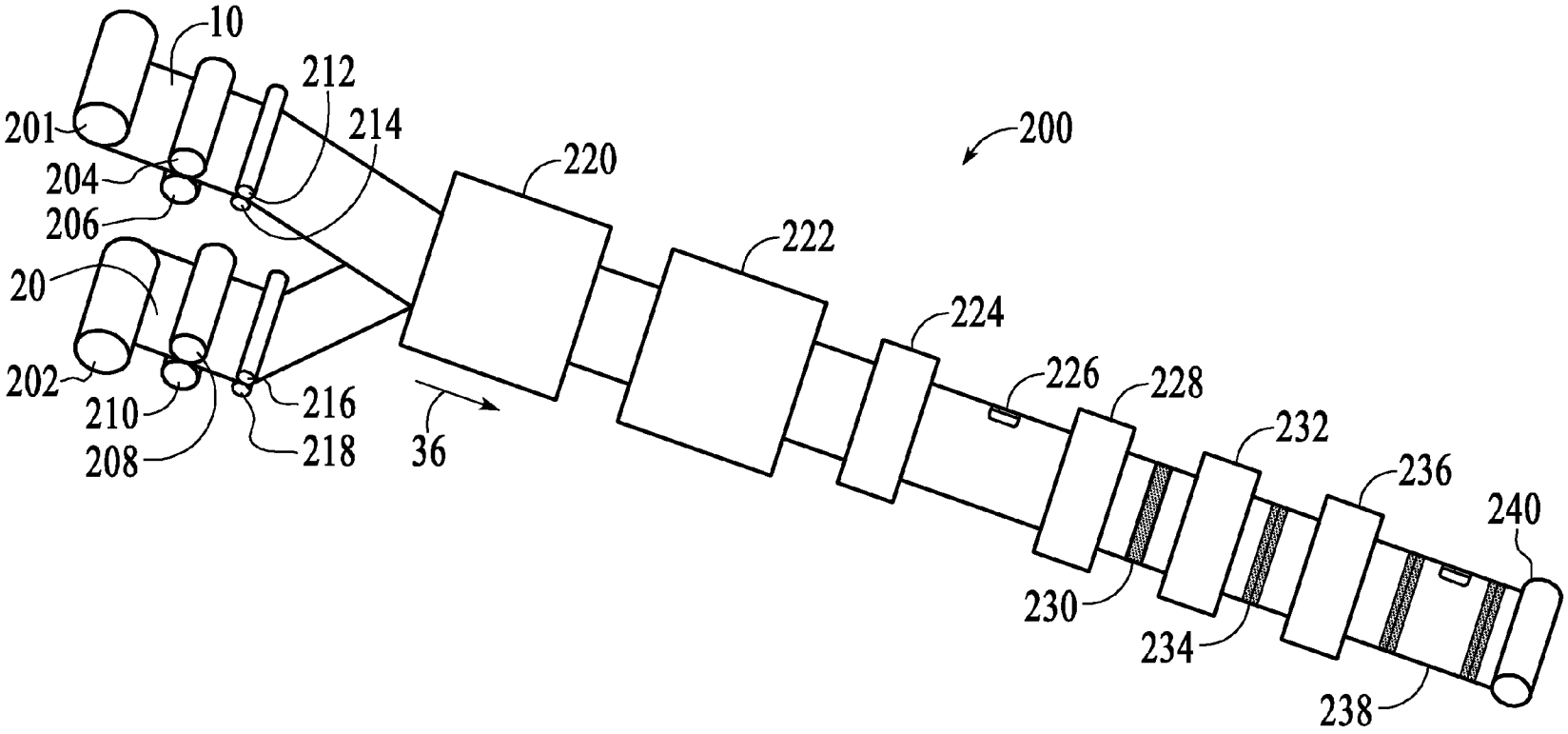
FIG. 12 illustrates a manufacturing process of the present invention.

Referring to FIG. 12, during the manufacturing process 200, the folded films 10, 20 can also pass through pairs of pinch rollers 212, 214, 216, 218. The pinch rollers 212, 214, 216, 218 can be appropriately arranged to grasp the folded films 10, 20. The pinch rollers 212, 214, 216, 218 may facilitate and accommodate the folded films 10, 20.

Next an insertion operation 220 can inserting the folded film 10 into the folded film 20. Insertion operation 220 can combine the folded films 10, 20 using any of the apparatus and methods described herein above in relation to FIGS. 9-11. In one or more implementations the insertion operation 220 can also laminate the folded films together 10, 20 (i.e., when the insertion operation 220 includes an applicator that applies a glue or other adhesive to one or more of the folded films 10, 20).

To produce a finished bag, the processing equipment may further process the multi-layer composite folded film 30 after it emerges from the insertion operations 220, 222. In particular, a draw tape operation 224 can insert a draw tape 226 into the composite folded film 30 at the open edge 34. Furthermore, a sealing operation 228 can form the parallel side edges of the finished bag by forming heat seals 230 between adjacent portions of the multi-layer composite folded film 30. The heat seals 230 may be incrementally spaced apart along the multi-layer composite folded film 30. The sealing operation 228 can form the heat seals 230 using a heating device, such as, a heated knife.

The sealing operation 228 can be part of a continuous or reciprocating bag making process. A continuous bag making process typically has an input section, a rotary drum, and an output section. The web continuously travels from the input section to the rotary drum and then to the output section. The input section generally consists of a driven unwind and dancer assembly to control film tension. The rotary drum contains a plurality of heated seal bars which can press against a sealing blanket to make seals forming bags from the web. End to end bags are formed with one seal from the drum and side to side bags are formed with a pair of seals. The drum diameter may be adjusted and/or less than all of the seal bars turned on to determine the distance between seals, and hence, bag size. The output section generally includes assemblies that act on a web downstream of the seals being formed, such as perforators, winders, folders and the like. The continuous bag making process has the advantage of operating at very high speeds (600 ft./min=300 bags/min), but is somewhat limited in the residence time afforded to make the side seals of the bags.

A reciprocating bag making process typically has an input section, a linear sealing section, and an output section. The input section generally consists of an unwind, a dancer assembly, and a driven nip. The film is unwound continuously from the roll and passes through the dancer assembly to the driven nip. The driven nip rotates intermittently, with one cycle of rotation reflecting the width of one bag. The time the nip is motionless is adjustable as required for downstream operations (such as sealing). The dancer assembly prior to the intermittently operating nip and after the continuously operating unwind station, gathers the film from the winder during the time the nip is not rotating, providing enough web material to satisfy the requirements of the nip when it begins rotating again. Hence, in the input section, the web unwinds from the roll in a continuous manner, travels through a dancer assembly that gathers the web material, and through a nip that operates in an intermittent manner, converting the web motion from a continuous motion to an intermittent motion, one bag width at a time. The linear sealing section of a reciprocating bag making process consists of one or more sealing stations with heated seal bars spaced one bag width apart, that contact the web each time the web motion stops as the film travels in a straight path through the machine. During the web stoppage time, each seal bar on a sealing station must move from a stationary position above or below the web to a position which places the seal bar in contact with the web. The seal bar then contacts the web for a period of time as required to make a seal. The seal bar then retracts to its original stationary position, after which the web advances intermittently one bag width and the process is repeated. One or more sealing stations may be required to provide the residence time as required for the seal. The reciprocating process has the advantage of long residence times and high quality seals, but is limited in rate (typically 120 bags/min).

A perforating operation 232 may form a perforation 234 in the heat seals 230 using a perforating device, such as, a perforating knife. The perforations 234 in conjunction with the folded edge 32 can define individual bags 238 that may be separated from the modified composite folded film 30. A roll or spool 240 can wind the modified composite folded film 30 embodying the finished bags 238 for packaging and distribution. For example, the roll 240 may be placed into a box or bag for sale to a customer.

In still further implementations, the multi-layer composite folded film 30 may be cut into individual bags along the heat seals 230 by a cutting operation 236. In another implementation, the multi-layer composite folded film 30 may be folded one or more times prior to the cutting operation 236. In yet another implementation, the side sealing operation 228 may be combined with the cutting and/or perforation operations 232, 236.

One will appreciate in light of the disclosure herein that the process 200 described in relation to FIG. 12 can be modified to omit or expanded acts, or vary the order of the various acts as desired. For example, two or more separate films or folded films can be inserted within the folded film 20 during the insertion operation 220

Implementations of the present invention can also include methods of inserting a folded film within another folded film. The following describes at least one implementation of a method with reference to the components and diagrams of FIGS. 9 through 12. Of course, as a preliminary matter, one of ordinary skill in the art will recognize that the methods explained in detail herein can be modified to install a wide variety of configurations using one or more components of the present invention. For example, various acts of the method described can be omitted or expanded, and the order of the various acts of the method described can be altered as desired.

For example, one method in accordance with one or more implementations of the present invention can involve advancing a folded film 20 a first direction of travel 36 in a first plane. The method can also involve advancing another folded film 10 in the first direction of travel 36 in a second plane. The first and second planes may be vertical planes that are offset or horizontal planes that are vertically offset.

The method can further involve redirecting the folded film 10 from the first plane to the second plane. For example, the method can involve redirecting the folded film 10 from the first direction of travel 36 to another direction of travel 54 that is perpendicular to the first direction of travel 36. In particular, the method can involve passing the folded film 10 about a direction change bar 56. The method can then involve passing the folded film 10 about one or more orientation rollers 60, 64 that redirect the folded film from the first plane to the second plane and from the direction of travel 54 to a direction of travel 42 that is opposite the direction of travel 54.

The method can additionally involve separating the halves of the folded film 20. For example, the method can involve passing the folded film 20 about a spreader bar 38. In particular, a first half 26 can pass on one side of the spreader bar 38 while a second half 28 of the folded film 20 passes on an opposing side of the spreader bar 38. Optionally, the method can further involve directing an additive out of the spreader bar 38 and onto the folded film 20.

The method can further involve inserting the folded film 10 into the folded film 20. For example, the method can involve advancing the folded film 10 between the first half 26 and the second half 28 of the folded film 20. The method can also involve redirecting the folded film 10 from the direction of travel 42 to the direction of travel 38 while between the first half 26 and the second half 28 of the folded film 20. For instance, the method can involve passing the folded film 10 about a direction change bar 44 situated between the first half 26 and the second half 28 of the folded film 20.

Accordingly, FIGS. 9-12 and the corresponding text, therefore, specifically show, describe, or otherwise provide a number of systems, components, apparatus, and methods for inserting a folded film into another folded film to create a multi-ply composite folded film. These apparatus and methods can insert a folded film into another folded film to create a multi-layer composite folded film which has the beneficial effects of the properties of both folded films.

There are several advantages associated a multi-ply composite folded film created in accordance with one or more implementations of the present invention The methods and apparatus described herein result in conservation of floor space in manufacturing thereby resulting in lowered capital costs. The methods and apparatus described herein disclose a simpler process design than previously available resulting in better reliability, and less wrinkles in the resulting product(s) due to a reduction in the process steps required since individual folding and unfolding of webs is not required. As the methods and apparatus described herein may decrease the time and complexity for inserting a folded film into another folded film, manufacturers can decrease the cost of their products if they use the one or more of the methods and apparatus described herein. These cost savings may be significant.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A draw tape bag having an interior and an exterior and comprising:

an outer transparent or translucent bag having a first sidewall made of a first flexible thermoplastic web material and a second sidewall of a sheet of flexible thermoplastic web material of the same sheet folded, overlaid and joined to the first sidewall to provide an interior volume, the first and second sidewalls joined along a first sealed side edge, an opposite second sealed side edge, and a closed bottom folded edge, the first and second sidewalls un-joined along their respective top edges to define an opening opposite the bottom edge for accessing the interior volume;

an inner transparent or translucent bag separated from and within the interior volume of the outer bag and having a first sidewall made of the first flexible thermoplastic web material and a second sidewall of a sheet of flexible thermoplastic web material of the same sheet folded, overlaid and joined to the first sidewall to provide an interior volume, the first and second sidewalls of the inner bag joined along the first sealed side edge and the second sealed side edge of the outer bag, and a closed bottom folded edge of the inner bag, the first and second sidewalls un-joined along their respective top edges to define an opening opposite the bottom edge for accessing the interior volume;

wherein the top edges of the first sidewalls of the inner and outer bags are attached together and the top edges of the second sidewalls of the inner and outer bags are attached together;

the first and second sidewalls of the outer bag and the first and second sidewalls of the inner bag folded over at the respective top edges and attached to the inside of the first and second sidewalls of the inner bag forming a hem extending along the open top end disposed opposite the bottom edge of the outer bag, the hem having a hem seal, the hem including one or more draw tape notches and a draw tape within the hem, the hem having an exterior surface and an interior surface where the outer bag first and second sidewalls form both the interior surface and the exterior surface of the hem;

wherein the sidewalls of the outer bag and the sidewalls of the inner bag:

contain greater than 50% LLDPE;

one or more of reclaimed resin from trash bags, processing aide, colorant containing carbon black, or a colorant containing white TiO2;

each have a machine direction to transverse direction tear ratio of 0.25 to 0.70; and are produced by a blown film process.

2. The draw tape bag of claim 1, wherein the draw tape is sealed at the first and second side seals.

3. The draw tape bag of claim 1, wherein the draw tape notches are centered between the first and second side edges.

4. The draw tape bag of claim 1, wherein the draw tape is not sealed at the first and second side seals.

5. The draw tape bag of claim 1, wherein the outer bag first sidewall is a coextruded multi-layer material.

6. The draw tape bag of claim 1, wherein the inner bag first sidewall is a coextruded multi-layer material.

7. The draw tape bag of claim 1, wherein the outer bag first sidewall is lightly tacked or selectively laminated to the inner bag first sidewall.

8. The draw tape bag of claim 1, wherein the inner bag has an interior surface and the hem seal is formed by attaching a hem flap of the inner bag to the interior surface of the sidewall of the inner bag.

9. The draw tape bag of claim 1, wherein the outer bag first sidewall is thicker than the inner bag first sidewall.

10. The draw tape bag of claim 1, wherein the outer bag first sidewall is thinner than the inner bag first sidewall.

11. The draw tape bag of claim 1, wherein the outer bag is longer than the inner bag.

12. The draw tape bag of claim 1, wherein the outer bag is liquid impervious and the inner bag is liquid pervious.

13. A draw tape bag having an interior and an exterior and comprising:

an outer transparent or translucent bag having a first sidewall made of a first flexible thermoplastic web material and a second sidewall made of the first flexible thermoplastic web material, overlaid and joined to the first sidewall to provide an interior volume, the first and second sidewalls joined along a first sealed side edge, an opposite second sealed side edge, and a closed bottom edge, the first and second sidewalls un-joined along their respective top edges to define an opening opposite the bottom edge for accessing the interior volume;

an inner transparent or translucent bag separated from and within the interior volume of the outer bag and having a first sidewall made of the first flexible thermoplastic web material and a second sidewall made of the first flexible thermoplastic web material, overlaid and joined to the first sidewall to provide an interior volume, the first and second sidewalls of the inner bag joined along the first sealed side edge and the second sealed side edge of the outer bag, and a closed bottom edge of the inner bag, the first and second sidewalls un-joined along their respective top edges to define an opening opposite the bottom edge for accessing the interior volume;

wherein the top edges of the first sidewalls of the inner and outer bags are attached together and the top edges of the second sidewalls of the inner and outer bags are attached together;

the first and second sidewalls of the outer bag and the first and second sidewalls of the inner bag folded over at the respective top edges and attached to the inside of the first and second sidewalls of the inner bag forming a hem extending along the open top end disposed opposite the bottom edge of the outer bag, the hem having a hem seal, the hem including one or more draw tape notches and a draw tape within the hem, the hem having an exterior surface and an interior surface where the outer bag first and second sidewalls form both the interior surface and the exterior surface of the hem;

wherein the sidewalls of the outer bag and the sidewalls of the inner bag:

contain greater than 50% LLDPE;

one or more of reclaimed resin from trash bags, processing aide, colorant containing carbon black, or a colorant containing white TiO2;

each have a machine direction to transverse direction tear ratio of 0.25 to 0.70;

are produced by a blown film process; and the combined thicknesses of the first sidewall of the outer bag and the first sidewall of the inner bag is less than 0.0015 inches (0.038 cm).

14. The draw tape bag of claim 13, wherein both the outer bag first sidewall and the inner bag first sidewall are each a coextruded multi-layer ply of material.

15. The draw tape bag of claim 14, wherein each layer of the outer bag first sidewall coextruded multi-layer ply and each layer of the inner bag first sidewall coextruded multi-layer ply each comprise greater than 50% LLDPE.

16. The draw tape bag of claim 13, wherein both the outer bag first sidewall and the inner bag first sidewall are each a coextruded tri-layer ply where the central layer contains recycled material.

17. The draw tape bag of claim 13, wherein the combined thicknesses of the first sidewall of the outer bag and the first sidewall of the inner bag is less than 0.001 inches (0.025 cm).

18. The draw tape bag of claim 13, wherein the outer bag closed bottom edge is a folded edge and the inner bag closed bottom edge is a folded edge.

19. The draw tape bag of claim 13, wherein the outer bag closed bottom edge is a sealed edge and the inner bag closed bottom edge is a sealed edge.

20. A draw tape bag having an interior and an exterior and comprising:

an outer transparent or translucent bag having a first sidewall made of a first flexible thermoplastic web material and a second sidewall made of the first flexible thermoplastic web material, overlaid and joined to the first sidewall to provide an interior volume, the first and second sidewalls joined along a first sealed side edge, an opposite second sealed side edge, and a closed bottom edge, the first and second sidewalls un-joined along their respective top edges to define an opening opposite the bottom edge for accessing the interior volume;

an inner transparent or translucent bag separated from and within the interior volume of the outer bag and having a first sidewall made of the first flexible thermoplastic web material and a second sidewall made of the first flexible thermoplastic web material, overlaid and joined to the first sidewall to provide an interior volume, the first and second sidewalls of the inner bag joined along the first sealed side edge and the second sealed side edge of the outer bag, and a closed bottom edge of the inner bag, the first and second sidewalls un-joined along their respective top edges to define an opening opposite the bottom edge for accessing the interior volume;

wherein the top edges of the first sidewalls of the inner and outer bags are attached together and the top edges of the second sidewalls of the inner and outer bags are attached together;

the first and second sidewalls of the outer bag and the first and second sidewalk of the inner bag folded over at the respective top edges and attached to the inside of the first and second sidewalls of the inner bag forming a hem extending along the open top end disposed opposite the bottom edge of the outer bag, the hem having a hem seal, the hem including one or more draw tape notches and a draw tape within the hem, the hem having an exterior surface and an interior surface where the outer bag first and second sidewalls form both the interior surface and the exterior surface of the hem;

wherein the sidewalls of the outer bag and the sidewalls of the inner bag:

contain greater than 50% LLDPE film oriented in the MD direction;

one or more of reclaimed resin from trash bags, processing aide, colorant containing carbon black, or a colorant containing white TiO2;

have a machine direction to transverse direction tear ratio of 0.25 to 0.70;

produced by a blown film process; and the combined thicknesses of the first sidewall of the outer bag and the first sidewall of the inner bag is less than 0.0015 inches (0.038 cm).

* * * * *